US005842799A

United States Patent [19]

Yamamoto et al.

[11] Patent Number: 5,842,799

[45] Date of Patent: Dec. 1, 1998

[54] RECORDING APPARATUS WITH SHEET GUIDE

[75] Inventors: Takashi Yamamoto, Nagoya; Mutsuo Fukuoka, Aichi-ken; Masaya Funamoto, Kasugai, all of Japan

[73] Assignee: Brother Kogyo Kabushiki Kaisha, Nagoya, Japan

[21] Appl. No.: 724,234

[22] Filed: Sep. 27, 1996

[30] Foreign Application Priority Data

Mar. 12, 1996 [JP] Japan ..... 8-084748

[51] Int. Cl.[6] ..... B41J 13/10

[52] U.S. Cl. ..... 400/645.4; 400/645.5

[58] Field of Search ..... 400/656, 692, 400/694, 713, 916, 634, 636, 637.2, 642, 645, 645.3, 645.4, 647.1, 645.5

[56] References Cited

U.S. PATENT DOCUMENTS

| | | | |
|---|---|---|---|
| 4,698,650 | 10/1987 | Watanabe et al. | 400/625 |
| 4,915,546 | 4/1990 | Kobayashi et al. . | |
| 4,981,380 | 1/1991 | Nishida et al. | 400/616.2 |

FOREIGN PATENT DOCUMENTS

| | | | |
|---|---|---|---|
| 0178779 | 11/1982 | Japan | 400/656 |
| 0091075 | 5/1984 | Japan | 400/656 |
| 0072761 | 4/1985 | Japan | 400/656 |
| A-63-285666 | 11/1988 | Japan . | |
| 6-64900 U | 9/1994 | Japan . | |

*Primary Examiner*—John S. Hilten
*Attorney, Agent, or Firm*—Oliff & Berridge, PLC

[57] ABSTRACT

A printer is provided with a platen having a sloping plane platen surface, a medium guide path for smoothly guiding paper along the plane including the platen surface, a transparent open/close paper guide positioned above the medium guide path, and two pairs of drive rollers and driven rollers arranged along the platen, with one pair of drive roller and driven roller being disposed in an upstream direction and the other pair of drive roller and driven roller being disposed in a downstream direction with respect to the platen and the paper print movement. The printer is further provided with a ribbon cassette which makes it possible to position a linear portion of an ink ribbon in parallel to the platen surface, a mechanism for switching the linear portion of the ink ribbon between a printable position and a nonprintable position, and a mechanism for attaching a ribbon cassette to a carriage while moving it in a downwardly forward direction.

15 Claims, 20 Drawing Sheets

RECORDING APPARATUS WITH SHEET GUIDE

BACKGROUND OF THE INVENTION

1. Field of the Invention

The invention relates to a printer, a recorder, and a ribbon cassette for use therewith. More particularly, the invention relates to a platen and a medium feeding mechanism which are improved so as to smoothly feed a recording medium (paper) along a flat sloping surface, and an improved ribbon cassette for use with them.

2. Description of Related Art

Like a type wheel printer as disclosed in, e.g., JP-A-63-285666, which is a priority document for U.S. Pat. No. 4,915,546, a conventional printer or a typewriter is provided with a cylindrical platen which has a cylindrical platen surface and a radius of about 2–3 cm. The medium feeding mechanism for feeding the recording medium comprises the cylindrical platen, a plurality of driven rollers disposed along the outer peripheral surface of the platen, and a curved paper guide attached to a carriage. The recording medium is fed from under the rear surface of the platen, and it follows around and along the platen surface. The recording medium is then discharged to a position above the rear surface of the platen.

Conventionally, a print head is positioned so as to be opposite to a substantially vertical-front portion of the platen. A linear portion of an ink ribbon to be used for printing is inserted, into an interval between the vertical-front portion and the print head, from above. To insert the ink ribbon, a ribbon cassette is attached to the carriage from above while being laterally moved back and forth slightly, whereby the linear portion of the ink ribbon is held substantially vertically.

To allow an operator to see a sequence of printed characters, the printer adopts a mechanism for vertically shifting the ribbon cassette mounted on a cassette receiver so as to switch between an upper nonprintable position and a lower printable position or a mechanism in which the cassette receiver is fixedly disposed on the carriage, and only the linear portion of the ink ribbon drawn out of the ribbon cassette is vertically shifted in a parallel manner so as to switch between the nonprintable position and the printable position.

A spool for feeding a tape (e.g., a correction tape for erasing characters or a red tape), other than an ink ribbon, is provided at the left end of the carriage in the conventional printer or typewriter. The tape is extended along the rear side of the linear portion of the ink ribbon and is taken up by a take-up spool disposed at the right end of the carriage. A guide mechanism is disposed so as to be independent of the ribbon cassette in order to guide the tape while maintaining it in a predetermined positional relationship with respect to the ink ribbon. A linear portion of the tape is also vertically switchable between a correctable position and an uncorrectable position.

As mentioned above, the medium guide path for guiding a recording medium is curved, at least, in the vicinity of the platen, which makes it impossible to print a thick recording medium (e.g., a card or an envelope) without bending it. The medium guide path is quite large vertically, which, in turn, renders the printer or the typewriter bulky. The recording medium is curved in the vicinity of the platen, which makes a viewable range of the recording medium around the platen small. If it is impossible for the operator to see a wide range of area of the recording medium, the operator may have difficulty filling in blanks in a printed form.

Conventionally, the distance between the printable position on the platen surface and the upper driven roller and the distance between the printable position and the lower driven roller are large, which makes it impossible to feed a recording medium having a small vertical width. Eventually, such a recording medium becomes nonprintable. Even in the case of a large recording medium, it is difficult to print letters on an upper edge of the recording medium, and it is impossible to print letters close to a lower edge of the recording medium.

As previously described, if the printer or the typewriter adopts the mechanism for vertically shifting the cassette receiver together with the ribbon cassette, the shifting movement of the mechanism makes the structure of the printer or the typewriter complicated. In the case of the mechanism for vertically shifting the linear portion of the ink ribbon in a parallel manner, a mechanism for vertically shifting both edges of the linear portion of the ink ribbon is complicated. Further, the guide mechanism for guiding a tape other than the ink ribbon is formed so as to be independent of the ribbon cassette. The structure of the guide mechanism is complicated, and interference is apt to occur between the ink ribbon and the tape.

Japanese Unexamined Utility Model Publication No. 6-64900 discloses a daisy-wheel typewriter that has a flat platen opposing the type face and print hammer. A straight paper feed path is provided from a bottom of the typewriter to a top. The object of the invention is to provide a prism lens 21 to enable the operator to see what is printed. However, this disclosure only has driven and drive rollers upstream of the print position in the direction of recording medium feed preventing printing on the upper end of the recording medium. Likewise, a paper having a small vertical width cannot be fed in such a typewriter.

SUMMARY OF THE INVENTION

An object of the invention is to make it possible to smoothly carry a recording medium along a plane which includes a sloping plane platen surface, to print both a thick recording medium and a small recording medium without bending them, to make it easy for an operator to see a wide range of area of the recording medium, to make a medium guide path for guiding a recording medium compact, to make the printer or typewriter compact, and to make a sequence of printed characters easy to see.

To achieve the above-mentioned objects, a printer comprises a platen having a sloping plane platen surface, and two pairs of drive and driven rollers for smoothly carrying a recording medium along a plane including the platen surface, with one pair of drive and driven rollers being disposed in an upstream direction and the other pair of drive and driven rollers being disposed in a downstream direction with respect to the platen as defined by a direction of movement of the recording medium. The recording medium is smoothly carried along the plane which includes the sloping plane platen surface by means of the two pairs of drive and driven rollers.

Further, the printer may include a transparent paper guide for guiding an upper side of the recording medium to be carried by the drive and driven rollers. With this configuration, it is possible for the operator to see a wide range of area of the recording medium through the transparent paper guide.

Further, the printer may be such that the driven rollers are rotatively attached to the paper guide. With this structure, the paper guide can be also used as a member for supporting the driven rollers.

Further, the printer may be such that a tapered portion for guiding the recording medium is formed at the end of the paper guide which is at right angles to the direction in which the recording medium is carried. With this structure, the tapered portion guides the recording medium making the travel of the recording medium smoother.

Further, the printer may be such that the paper guide is formed so as to be manually switchable between a closed position for guiding the recording medium and an open position in which the paper guide is upwardly opened. With this arrangement, it becomes possible to set the recording medium to the printer or move the recording medium while the paper guide is switched to the open position.

Further, the printer may be such that a spring member for forcing the paper guide to the closed position is disposed so as not to impair visibility of the recording medium. With this structure, it is possible to see a wide range of the area of the recording medium, which makes it easy for the operator to check the layout of printed letters. Thus, work efficiency is improved.

Further, the printer may be such that the platen surface is laid at an angle of about 20 to 70 degrees with a rear upward gradient in relation to the horizontal plane. When the platen surface, i.e., the surface of the recording medium, lies at an angle of about 20 to 70 degrees with a rear upward gradient in relation to the horizontal plane, it becomes easy for the operator to see the sequence of printed letters. Particularly, it is desirable to set the platen surface at an angle of about 40 degrees with a rear upward gradient in relation to the horizontal plane.

Throughout the specification, the term "front" is used to designate the part of the printer closest to the operator, whilst the term "rear" is used to designate the part of the printer away from the operator's position.

In another aspect, the printer comprises a platen having a sloping plane platen surface, a medium guide path for guiding a recording medium such that the recording medium is smoothly carried along a plane including the platen surface, the medium guide path including a base plate and a transparent paper guide positioned above the base plate so as to be opposite to the base plate in such a way as to ensure a clearance for the passage of the medium, and medium feed mechanism that carries the recording medium along the medium guide path. The medium guide path guides the recording medium such that the recording medium is smoothly carried along the plane including the sloping plane platen surface. The medium feed mechanism carries the recording medium along the medium guide path. Since the medium guide path is provided with the lower base plate and the upper transparent paper guide, it is possible to reliably guide the recording medium. Further, it is possible for the operator to see a wide range of the upper area of the recording medium through the transparent paper guide. As a result, it is possible for the operator to check the overall layout of the sequence of printed letters or to complete blanks in a printed form.

Further, the medium feed mechanism may be provided with a pair of drive and driven rollers which are disposed at least at an upstream position or a downstream position in the direction in which the recording medium is fed in relation to the platen. If the pair of drive and driven rollers are disposed in the upstream direction in relation to the platen, it becomes possible to print letters from the upper edge of the recording medium. On the other hand, if the pair of drive and driven rollers are disposed in the downstream direction in relation to the platen, it becomes possible to print letters up to the lower edge of the recording medium.

Further, the printer may be such that the medium feed means is provided with two pairs of drive and driven rollers, with one pair of drive and driven rollers being disposed in an upstream direction and the other pair of drive and driven rollers being disposed in a downstream direction in relation to the platen. With this configuration, it becomes possible to print letters from the upper edge to the lower edge of a recording medium as well as to print letters on a recording medium having a smaller vertical width.

Further, the printer may be such that the driven roller is rotatively attached to the paper guide. With this structure, the paper guide can be also used as a member for supporting the driven roller.

DESCRIPTION OF THE PREFERRED EMBODIMENT

An electronic typewriter and a ribbon cassette for use therein according to an embodiment of the invention will be described hereinbelow with reference to the accompanying drawings. Throughout the illustrated embodiment, the "front," "rear," "right," and "left" directions are used herein to describe the corresponding directions of the electronic typewriter and the ribbon cassette as they are viewed from an operator's position.

Figure 1:
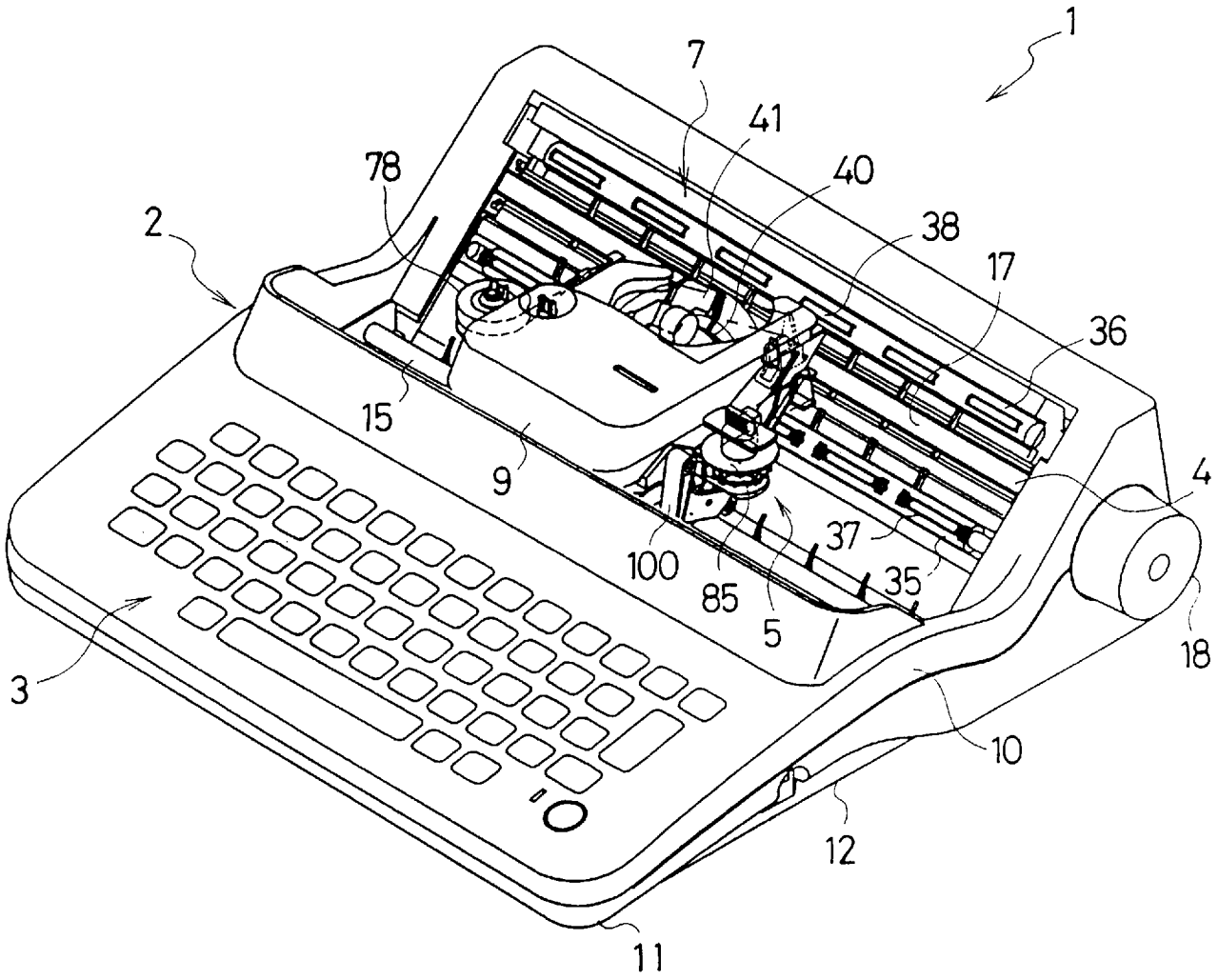
FIG. 1 is a perspective view of a typewriter according to an illustrative embodiment of the invention.
Figure 2:
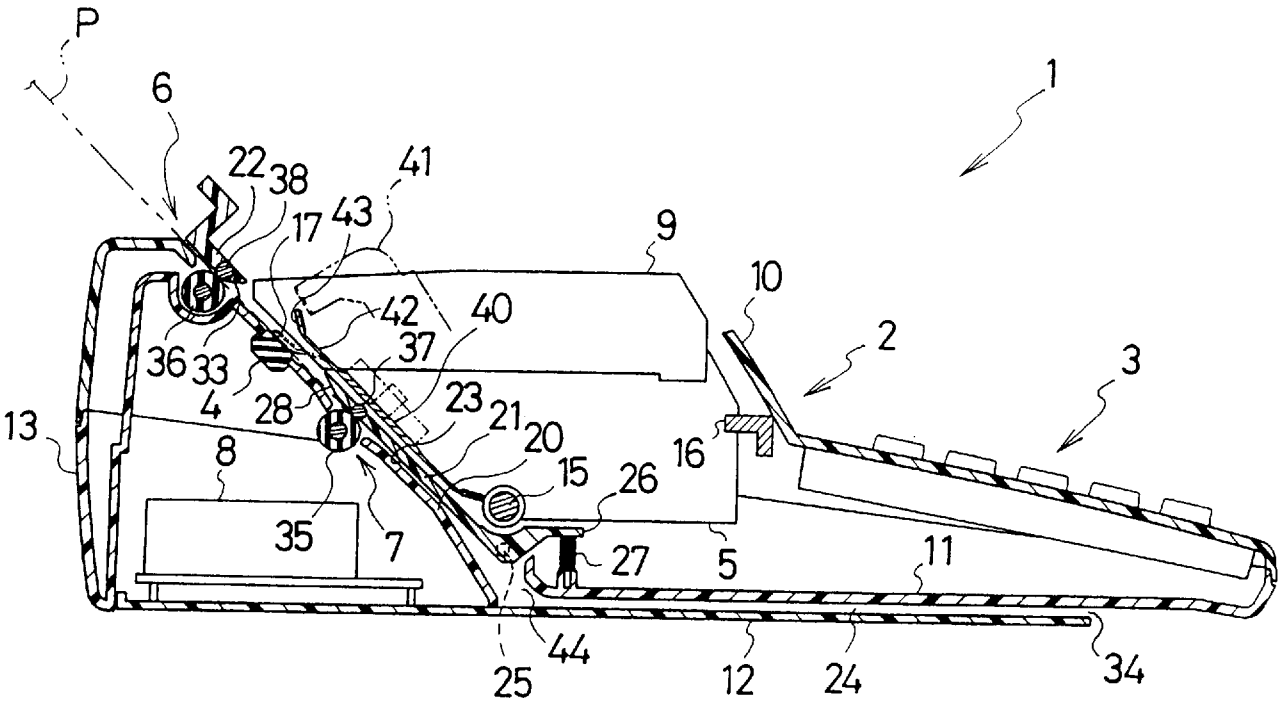
FIG. 2 is a longitudinal side, cross sectional view of the typewriter.
Figure 3:
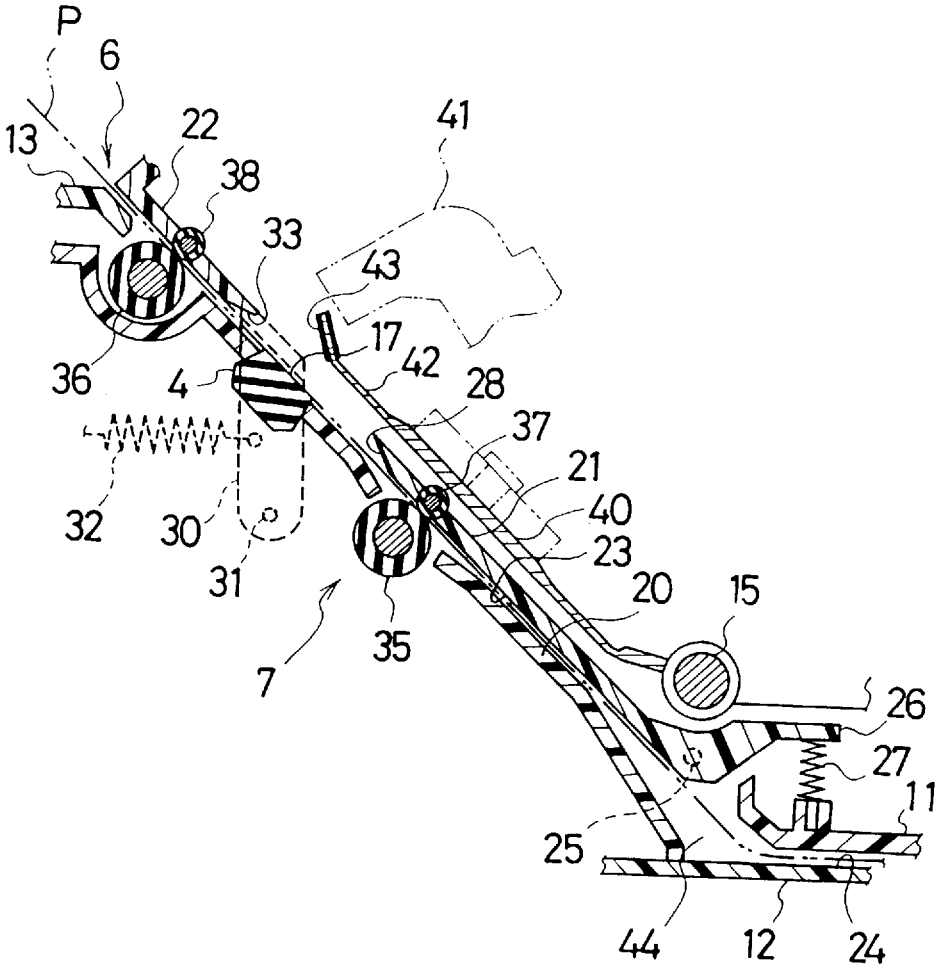
FIG. 3 is an enlarged view of the principal elements of the typewriter as shown in FIG. 2.

As shown in FIGS. 1 through 3, an electronic typewriter 1 is provided with a main body case 2, a keyboard 3 disposed in an upper, front portion of the main body case 2, a platen 4, a carriage 5, various mechanisms attached to the carriage 5 (e.g., a print mechanism, a mechanism for moving the carriage, a ribbon take-up mechanism for feeding an ink ribbon, a mechanism for switching the position of the ink ribbon, a take-up mechanism for taking up a correction tape, and a mechanism for changing the position of the correction tape), a medium guide mechanism 6 for guiding a recording medium, a medium carrying mechanism 7 for feeding the recording medium, a carriage drive mechanism control unit 8 for moving the carriage 5 in a horizontal direction, and a ribbon cassette 9 removably attached to the carriage 5.

The main body case 2 is made up of an upper cover 10, a lower cover 11, a bottom cover 12, and a rear cover 13. The covers 10–13 are made from synthetic resin. The main body case 2 is further provided with a metal main frame (not shown). The carriage 5 is guided so as to horizontally travel along a guide shaft 15 and a guide bar 16. The carriage drive mechanism has a common structure (not shown) made up of a pair of wire guide rings, a wire connected to the carriage 5 through the wire guide rings, and a pulse motor for driving the wire.

As shown in FIGS. 2 and 3, the platen 4, made from hard synthetic rubber, has a plate platen surface 17 with a rear upward gradient of about 45 degrees in relation to the horizontal plane. The platen surface 17 has a narrow width in the direction in which the recording medium is fed, and it is extended into a strip shape in the horizontal direction. The platen 4, thus, is a small bar having a substantially rectangular cross section. The inclination should preferably be set to about 20 to 70 degrees in relation to the horizontal plane and, most preferably, be set to about 40 to 45 degrees. The platen 4 is disposed at a slightly upper position with respect to the middle of a paper guide path 23 of the medium guide mechanism 6.

The medium guide mechanism 6 is intended to smoothly guide the recording medium (hereinafter referred to as paper) along the plane including the sloping plane platen surface 17. The medium guide mechanism 6 comprises a base plate 20 which is made from synthetic resin and is disposed along the plane including the platen surface 17, transparent paper guides 21, 22 which are made from synthetic resin and are placed on, and parallel to, the base plate 20, the paper guide path 23 formed between the base plate 20 and the paper guides 21, 22, and a paper guide path 24 which communicates with the lower end of the paper guide path 23 and is formed between the bottom cover 12 and the lower cover 11.

Most of the upper surface of the base plate 20 lies all in the same plane as the plane including the platen surface 17, and the platen 4 is fixed to the base plate 20. The lower transparent paper guide 21 is formed so as to have a width about half the lower portion of the base plate 20. The lower end of the paper guide 21 is pivotally supported on the main frame with a pair of pins 25. A compression spring 27 is interposed between a spring receiver 26 at the lower end of the paper guide 21 and the lower cover 11. The compression spring 27 forces the paper guide 21 toward the base plate 20. The lower surface of the upper end of the paper guide 21 is formed into a taper 28 so as to guide the paper P toward the paper guide path 23.

The upper transparent paper guide 22 is formed to have a smaller vertical width, and a pair of arms 30 downwardly extending from both sides of the upper transparent paper guide 22 are pivotally supported by the side walls of the main frame with pins 31. Tension springs 32 for forcing the pair of arms 30 force the paper guide 22 toward the base plate 20. The lower surface of the lower end of the paper guide 22 is formed into a taper 33 so as to guide the paper P toward the paper guide path 23. The paper guides 21, 22 are manually switchable between a closed position where they are situated close to the base plate 20 and an open position where they are opened upward. The paper guides 21, 22 are forced toward the closed position by the springs 27, 32.

As shown in FIGS. 2 and 3, the medium carrying mechanism 7 is intended to carry the paper P along the paper guide path 23 or the paper guide paths 23, 24 in substantially a vertical direction. To feed the paper P, the paper P, which is long in the vertical direction, may be fed through a paper inlet 34 of the paper guide path 24, or it may be fed through the upper end of the paper guide path 23. In the case of the paper P having a smaller width in the vertical direction, the paper is fed through the upper end of the paper guide path 23. When letters are printed on the thus set paper P, the paper is upwardly fed. Therefore, an upstream direction and a downstream direction are defined with respect to the direction in which the paper is fed during the course of the above described printing operation.

The medium carrying mechanism 7 comprises a drive roller 35 which is positioned in the upstream direction with respect to the platen 4, when the paper is fed from the paper unit 34 and extends horizontally, a drive roller 36 which is positioned in the downstream direction with respect to the platen 4 and also extends horizontally, a plurality of driven rollers 37 which come into contact with the drive roller 35 from above, a plurality of driven rollers 38 which come into contact with the drive roller 36 from above, and drive means (an electric motor and a gear mechanism) for driving the drive rollers 35, 36. The transfer plane stretching between the drive rollers 35, 36 lies in the same plane as the plane including the platen surface 17. The drive rollers 35, 36 have a small diameter of about 1 to 2 cm, and both ends of each of the drive rollers 35, 36 are rotatively supported by the main frame. Each of the drive rollers 35, 36 is provided with a knob 18 for manually rotating the roller.

The plurality of driven rollers 37 have a diameter slightly larger than the thickness of the paper guide 21. The driven rollers 37 are rotatively supported by the paper guide 21, and they are forced toward the drive roller 35 via the paper guide 21 by means of the driving force of the compression spring 27. The plurality of rollers 38 have a diameter slightly larger than the thickness of the paper guide 22. The driven rollers 38 are rotatively supported by the paper guide 22, and they are forced toward the drive roller 36 via the paper guide 22 by means of the driving force of the tension springs 32.

The common structure of the print mechanism mounted on the carriage 5 comprises a type wheel 40 (daisy wheel) removably attached to the carriage 5, a pulse motor (not shown) for forwardly or reversely rotating the type wheel 40, a print hammer 41 for striking a type selected from the type wheel 40, and a solenoid (not shown) for actuating the print hammer 41. The print hammer 41 associated with the selected type corresponds to the print head. The type wheel 40 is disposed substantially in parallel with the paper guide path 23, and this arrangement is a characteristic feature of the invention.

A plurality of spokes 42 radially extending from the type wheel 40 are elastically formed and are disposed substantially parallel to the paper guide path 23. A type 43 is integrally attached to the tip end of each spoke 42 so as to be inclined toward the print hammer 41. The type 43 is struck against the platen surface 17, with an ink ribbon 110 and the paper P interposed between them, by means of elastic deformation of the spoke 42 resulting from the striking action.

As described above, the printer 1 is provided with the platen 4 having the sloping plane platen surface 17, and the paper guide path 23 is formed so as to guide the paper P along the plane including the platen surface 17. Further, the paper P is smoothly carried by means of the medium carrying mechanism 7, and the paper guides 21, 22 are vertically pivoted according to the thickness of the paper P. Therefore, it is easy for an operator to see a wide range of the surface of the paper P when typing the paper P, which results in improved working efficiency. Further, it is possible to print thick paper (e.g., thick paper, a card, or an envelope) without folding it. The two pairs of drive rollers 35, 36 and driven rollers 37, 38 are arranged along the platen 4, with one pair of drive roller and driven rollers being disposed in the upstream direction and the other pair of drive roller and driven rollers being disposed in the downstream direction with respect to the platen 4. As a result, it is possible to reliably feed paper having a small vertical width (e.g., a name card, a card, a check, or a notepad) for printing. Further, it is possible to print from the upper end to the lower end of the paper P.

The paper guides 21, 22 are made from transparent synthetic resin, and they are arranged so as to allow the operator to see the surface of the paper P therethrough. Consequently, it is possible for the operator to see a wide range of the area of the paper P and to check the layout of the printed letters on the surface of the paper P. The operator is enabled to complete blanks in a printed matter, which results in improved working efficiency.

The tapers 28, 33, formed on the paper guides 21, 22 respectively, make it possible to guide the paper P toward the paper guide path 23, thereby ensuring the transfer of the paper P. The paper guides 21, 22 can be opened upward, as required, which makes it convenient to correct the position of the paper P. Further, the platen 4 and the medium carrying mechanism 7 are compact, which makes it possible to reduce the size of the typewriter 1 to a much greater extent.

The clearance of the paper guide paths 23, 24 is sufficient to permit the passage of thick paper. It is also sufficiently possible to increase the radius of curvature of a curved section 44 at which the paper guide path 23 and the paper guide path 24 communicate with each other to a much greater extent to permit smoother passage of the thick paper or an envelope, as required. Therefore, the paper P can be smoothly fed, and carrier resistance becomes smaller.

Figure 15:
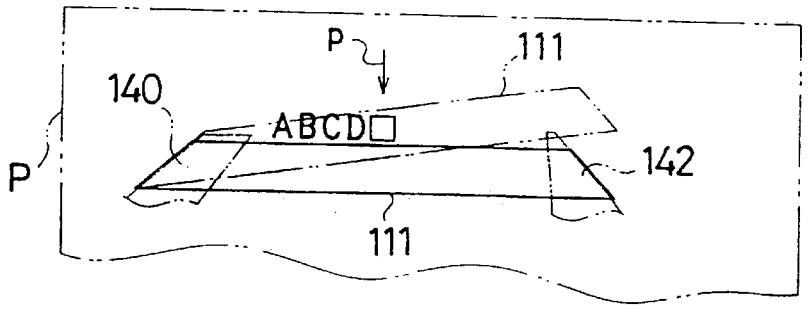
FIG. 15 is an illustration for explaining the switching of the positions of a linear portion of the ink ribbon.

As will be described later, a linear portion 111 of the ink ribbon 110, which is drawn from the ribbon cassette 9, attached to the carriage 5, to the area in front of the platen surface 17, is arranged in parallel to the platen surface 17. As shown in FIG. 15, when viewed from the front (the operator's position), the linear portion 111 of the ink ribbon 110 is switched between a nonprintable position in which the linear portion is retained horizontally (as designated by the solid line in FIG. 15) and a printable position (as designated by the chain line in FIG. 15) in which the linear portion 111 is inclined such that its right end (a print-operation end) is held at an elevated position.

Figure 3A:
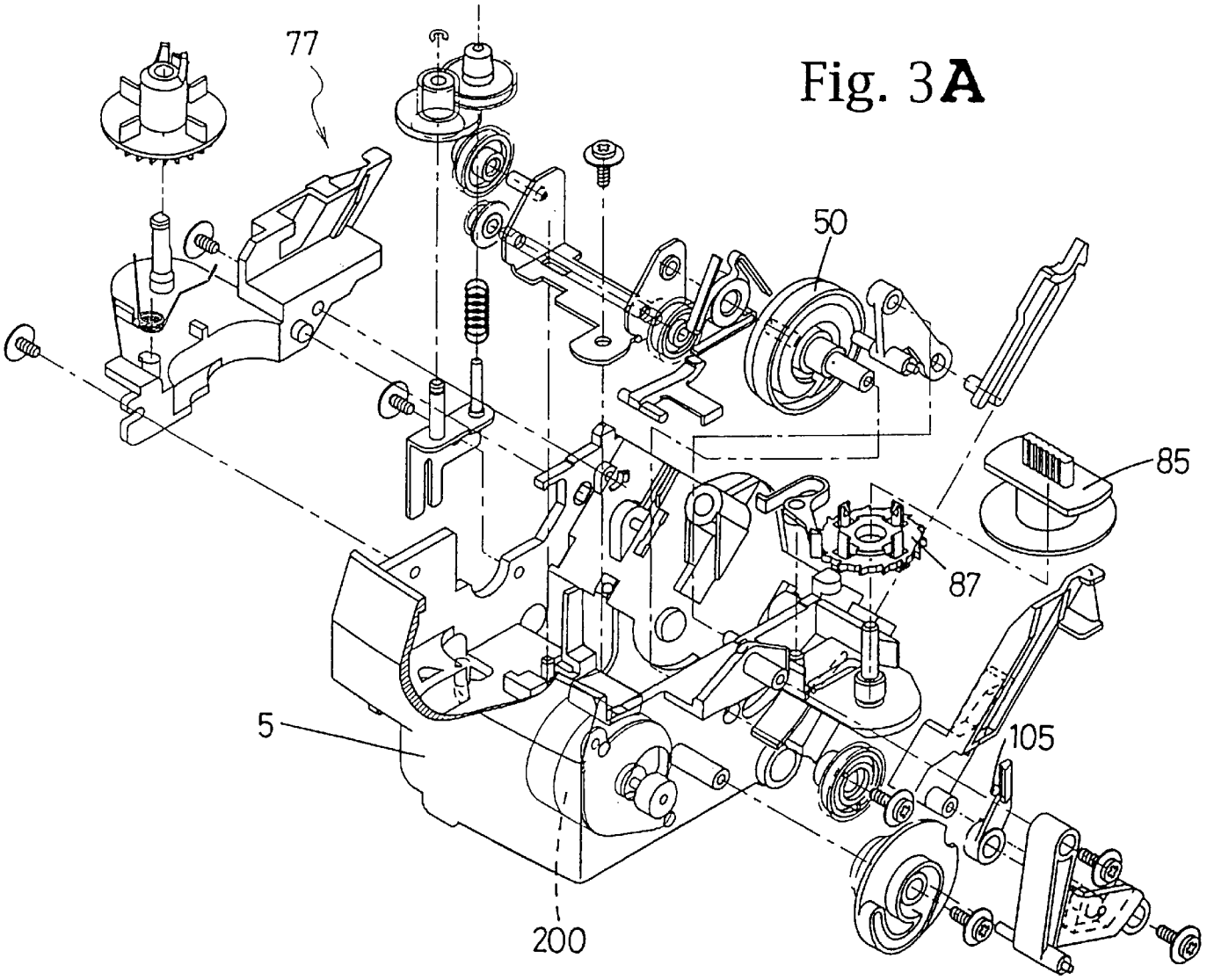
FIG. 3A is an exploded perspective view of the typewriter carriage.

FIG. 3A provides an exploded, perspective view of carriage 5. The view shows the relationships of the elements that will be described in detail with reference to FIG. 3A.

With reference to FIGS. 3A through 6, a mechanism for switching the linear portion 11 of the ink ribbon 110 between the above described printable and nonprintable positions, and a mechanism for taking up the ink ribbon 110 within the ribbon cassette 9 will now be described. These mechanisms are contained in the print mechanism, and the carriage 5 is provided with that print mechanism.

Figure 4:
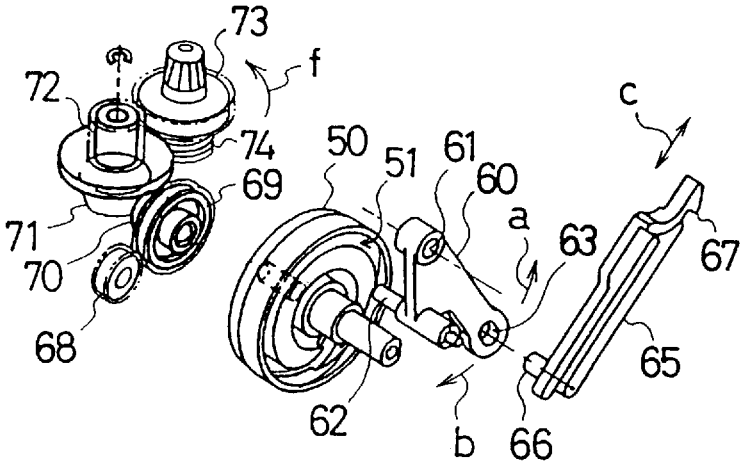
FIG. 4 is a perspective, exploded view of the principal elements of a mechanism for switching the positions of an ink ribbon and a mechanism for taking up the ink ribbon.
Figure 5:
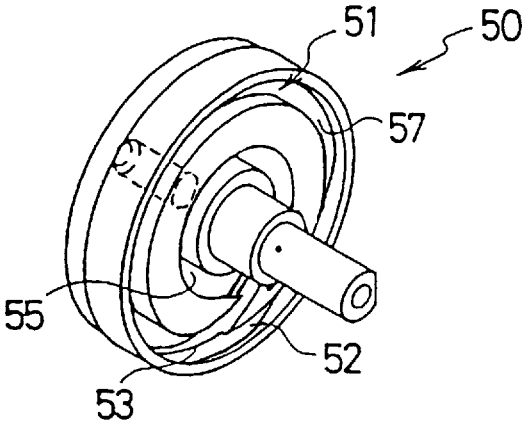
FIG. 5 is a perspective view of a cam member for raising the ribbon.
Figure 6:
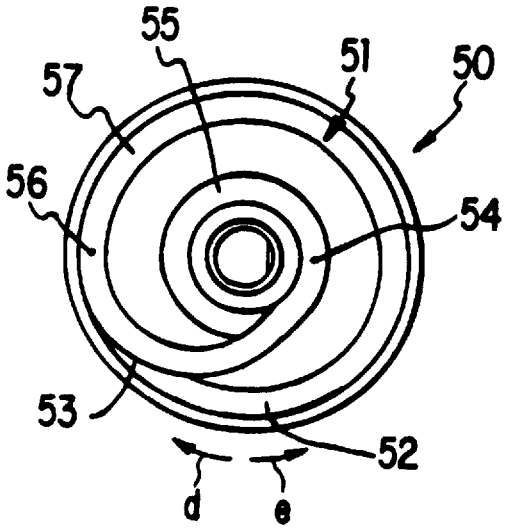
FIG. 6 is a side view of the cam member for raising the ribbon.

As shown in FIGS. 4 to 6, a ribbon lift cam member 50 is rotatively supported by the carriage 5. An open cam groove 51 is formed on the right side of the cam body 50. A pivotal link 60 is supported by the carriage 5 so as to pivot around a fulcrum 61. A pin 62 of the pivotal link 60 is engaged with the cam groove 51, and a pin 66 of a ribbon slider 65 is inserted into a pin hole 63 of the pivotal link 60. A lower end portion 52 of the cam groove 51, shown in FIG. 6, has a gradually shallower bottom in the direction designated by the arrow "d." The cam groove has a deep drop nearby a stepped line 53. The top of the ribbon slider 65 is removably engaged with an engaging section 141*a* of a ribbon guide 141 disposed on the right side of the ribbon cassette 9 (see FIG. 10). The ribbon slider 65 is movably guided in parallel to the platen surface 17 in the direction designated by the arrow "c" by means of the guide section of the carriage 5.

When the pin 62 of the pivotal link 60 is situated in a minimum diameter cam groove 55 of the cam groove 51 which includes a point 54, the pivotal link 60 downwardly pivots, and the linear portion 111 of the ink ribbon 110 is positioned horizontally and, eventually, situated in the nonprintable position. On the other hand, when the pin 62 of the pivotal link 60 is positioned in the maximum diameter guide groove 57 of the cam groove 50 which includes a point 56, the pivotal link 60 pivots upwardly, and the right side of the linear portion 111 of the ink ribbon 110 is raised. Eventually, the linear portion 111 is situated in the printable position. The cam body 50 is actuated by a pulse motor 200 via a gear mechanism (not shown). When the cam body 50 is rotated in the direction designated by the arrow "e," the pin 62 travels along the maximum diameter cam groove 57. On the other hand, when the cam body 50 is rotated in the direction designated by the arrow "d," the pin 62 enters the minimum diameter cam groove 55. Therefore, the ribbon slider 65 is raised or lowered via the cam body 50 and the pivotal link 60 by the pulse motor 200. As a result, it is possible to switch the position of the linear portion 111 of the ink ribbon 110.

The ink ribbon 110, housed within the ribbon cassette 9, is taken up by rotating a take-up drive gear 73 (a drive shaft) in the direction designated by the arrow "f" (FIG. 4) via gears 68, 69, bevel gears 70, 71, and a gear 72 by means of torque supplied from the pulse motor. These gears are respectively supported by the carriage 5. As will be described later, a drive roll with pawls 138 for taking up purposes, disposed in the ribbon cassette 9, removably engages with the drive gear 73, and the drive roll with pawls 138 is actuated by the drive gear 73 (see FIG. 10). The drive gear 73 is axially movably at a predetermined small stroke in the vertical direction, and it is forced upwardly by the compression spring 74.

Figure 7:
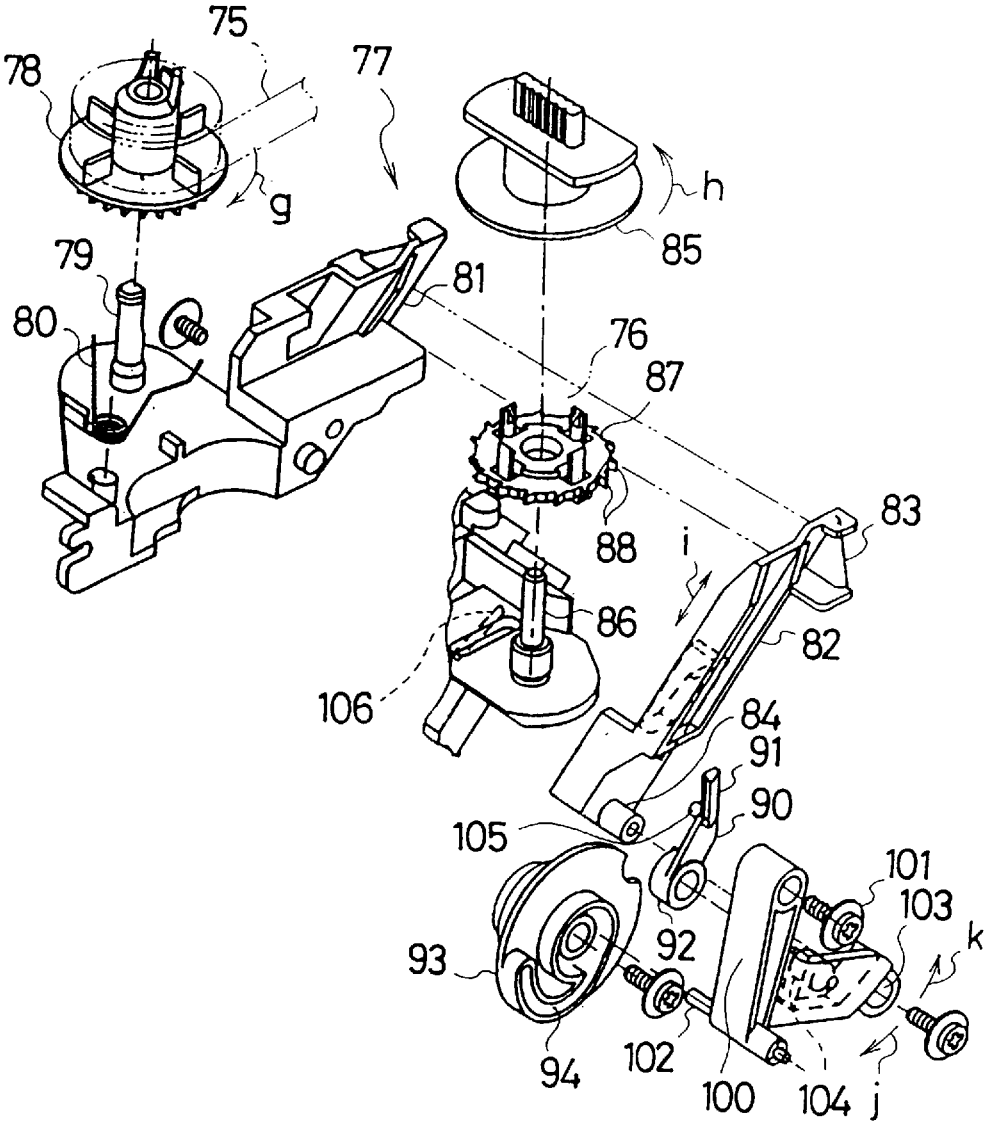
FIG. 7 is a perspective, exploded view of the principal elements of a mechanism for guiding a correction tape, a mechanism for changing the positions of the correction tape, and a mechanism for taking up the correction tape.
Figure 8:
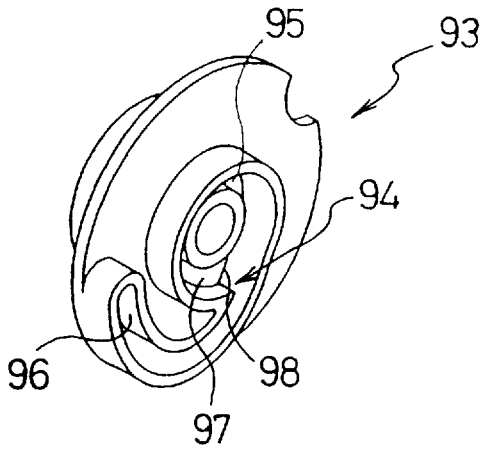
FIG. 8 is a perspective view of a cam member for raising a tape member.
Figure 9:
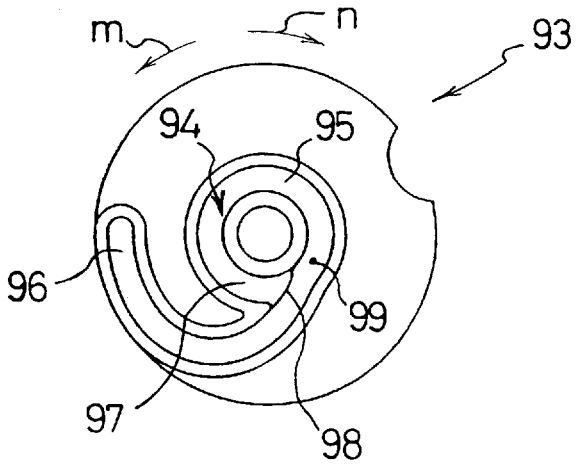
FIG. 9 is a side view of the cam member for raising the tape member.

With reference to FIGS. 7 to 9, a guide mechanism 77 for guiding a tape 75 for correcting purposes (a correction tape) and a take-up mechanism, including a take-up spool 85 mounted on the carriage 5, for taking up the correction tape 75 when letters are erased will now be described. The carriage 5 is provided with these mechanisms as shown in FIG. 3A. The correction tape 75 is formed such that a printed letter is bonded to an adhesive layer on the surface of the correction tape 75, and that the adhesive layer to which the letter is bonded is then peeled from the correction tape. A linear portion 76 of the correction tape 75 is situated in the space between the paper P and the linear portion 111 of the ink ribbon 110. The correction tape 75 is switchable between a correctable position, shown in FIG. 20, and an uncorrectable position, shown in FIG. 22. The linear portion 76 of the correction tape 75 is inclined with its right end raised when it is in the correctable position, whilst it is horizontally situated when in the uncorrectable position.

The correction tape 75 is fed from the tape feed spool 78, and it is then taken up by a tape take-up spool 85 via a left guide section 81 fixedly formed in the carriage 5 and a right guide section 83 formed in a tape slider 82. The tape feed spool 78 is supported by a shaft 79 and is forced in the direction designated by the arrow "g" by means of a spring 80 in order to afford a tensile force to the correction tape 75. The take-up spool 85 is engaged with a spool support 87 supported by a shaft 86. As a result of ratchet teeth 88 of the spool support 87 being pushed rearwardly by a feed pawl 91 of a feed pawl member 90, the take-up spool 85 is actuated every letter in a stepped manner in the direction designated by the arrow "h."

The tape slider 82 is guided toward the guide section of the carriage 5 so as to be movable in the direction designated by the arrow "i" (in the direction parallel to the platen surface), and a tape lift cam member 93 is rotatively attached to the wall of the carriage 5. An open cam groove 94 is formed on the right side of the cam member 93. A pivotal link 100 is rotatively supported by the carriage 5 with a machine screw 101. A pin 102 of the pivotal link 100 engages with the cam groove 94, and the shaft 84 of the tape slider 82 is engaged with a hole 103 of the pivotal link 100.

The cam groove 94 is provided with a minimum diameter cam groove 95 and a maximum cam diameter cam groove 96. The area of the minimum diameter cam groove 95 designated by reference numeral 97 has a gradually shallower bottom in the direction designated by the arrow "m," and the cam groove 94 has a deep drop nearby a stepped line 98. When the pin 102 is guided along the inside of the minimum diameter cam groove 95, the pivotal link 100 is pivotally moved in the direction designated by the arrow "j." Then, the tape slider 82 drops down, and the linear portion of the correction tape 75 is situated at the nonprintable position. On the other hand, when the pin 102 is guided along the inside of the maximum diameter cam groove 96, the pivotal link 100 is pivotally moved in the direction designated by the arrow "k." Consequently, the tape slider 82 is raised, and the right side of the linear portion 76 of the correction tape 75 is raised, whereby the linear portion is situated in the printable position.

The cam lift member 93 for correcting purposes is rotated via a gear mechanism (not shown) by the pulse motor identical with, or another pulse motor differing from, the pulse motor for driving the ribbon lift cam body 50. When the correction tape 75 is switched to the correctable position, the cam lift member 93 is rotated through a predetermined angle in the direction designated by the arrow "m."When the correction tape 75 is not used, the pin 102 is held at a point 99 in the minimum diameter cam groove 95.

In the mechanism for feeding the correction tape 75 in a stepped manner, a cylindrical section 92 of the feed pawl member 90 is rotatively fitted around a shaft 104 of the pivotal link 100. A pin 105 of the feed pawl member is engaged with an inclined hole 106 formed in the vertical wall of the carriage 5 (FIG. 3A) so as to be vertically movable. The feed pawl 91 is engaged with the ratchet teeth 88 of the spool support 87 so as to be vertically movable. For this reason, when the pivotal link 100 pivots in the direction designated by the arrow "k," the feed pawl member 90 is raised, and the feed pawl 91 is also raised along the inclined hole 106. As a result, the ratchet teeth 88 are fed in a stepped manner, and the correction tape 75 is fed to the take-up spool 85 in a stepped manner.

The ribbon cassette mounted to the typewriter 1 will now be described.

Figure 10:
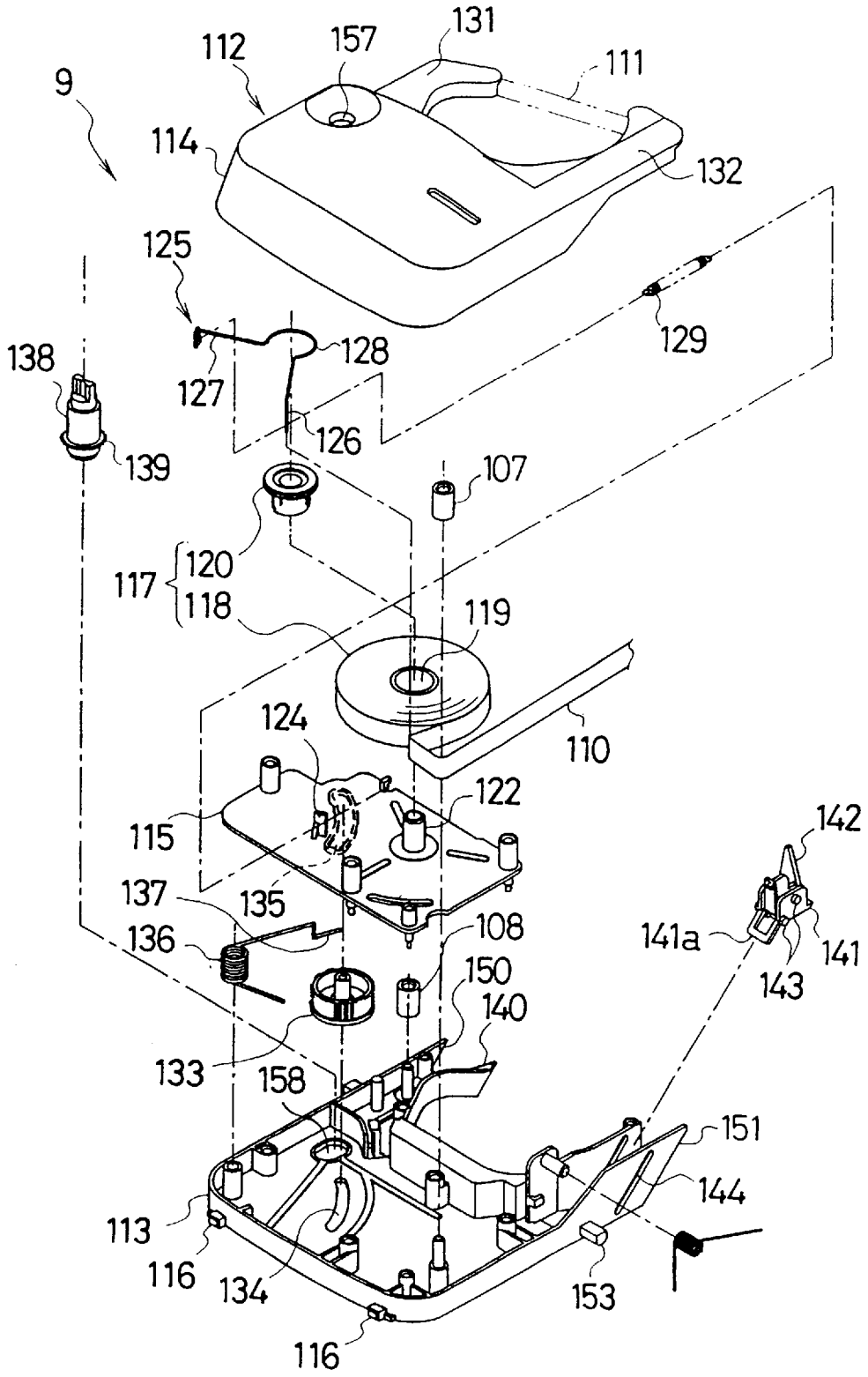
FIG. 10 is a perspective, exploded view of a ribbon cassette.
Figure 11:
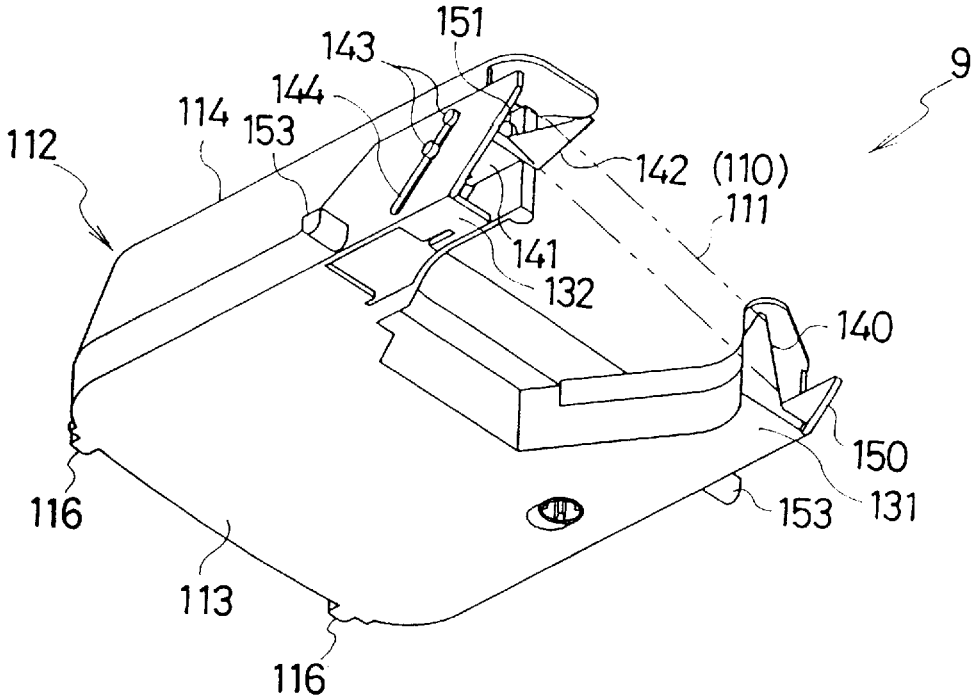
FIG. 11 is a perspective view of the ribbon cassette.
Figure 12:
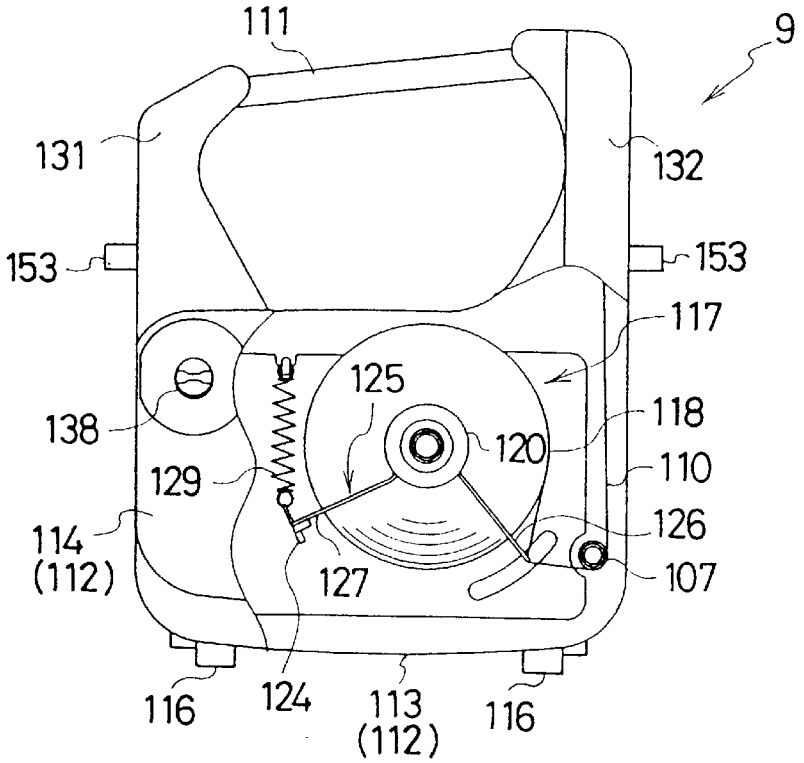
FIG. 12 is a partially cutaway, plan view of the ribbon cassette.

As shown in FIGS. 10 to 12, a cassette main body 112 of the ribbon cassette 9 comprises a lower case 113, an upper case 114, and a partition 115. A pair of ribbon supports 131, 132 project from the rear portion of the cassette main body 112. An ink ribbon member 118, around which the ink ribbon 110 is helically wrapped, is disposed on the top of the partition 115. A core shaft 120 is fixedly fitted into a cylindrical hole 119 formed in the ink ribbon member 118, and the core shaft 120 is rotatively fitted around a support shaft 122. The ink ribbon member 118 and the core shaft 120 make up the feed spool 117 of the ink ribbon 110.

A tension spring 125 (a first elastic member) is integrally made up of a combination of an engaging lever 126 which engages with the ink ribbon 110 drawn out of the feed spool 117 and affords a tensile force to the ink ribbon 110, a joint lever 127 which is connected to an extension spring 129 (a second elastic member), and a curved section 128 which connects the engaging lever 126 to the joint lever 127. The curved section 128 is fitted around the core shaft 120 and resilient holds the core shaft 120. The ink ribbon 110, unreeled from the feed spool 117, arrives at the ribbon support section 132 via the engaging lever 126 and a guide ring 107. The linear portion 111 extends between the ribbon support sections 131, 132. The ink ribbon 110, is then guided below the partition 115 from the ribbon support section 131, and it is further guided by the guide ring 108. The ink ribbon is finally taken up by the take-up spool 133.

The take-up spool 133, for taking up the spent ink ribbon 110, is movably supported between circular-arc openings 134, 135. The take-up spool 133 is forced toward the drive roller with pawls 138 by an arm 137 of the torsion spring 136. A plurality of teeth 139 formed along the outer periphery of the drive roll with pawls 138 mesh with the outer periphery of the ink ribbon 110 coiled around the take-up spool 133. As a result of the drive roller with pawls 138 being actuated by the drive gear 73 disposed on the carriage 5, the take-up spool 133 is actuated by the drive roll with pawls 138 so as to perform the take-up action.

Figure 13:
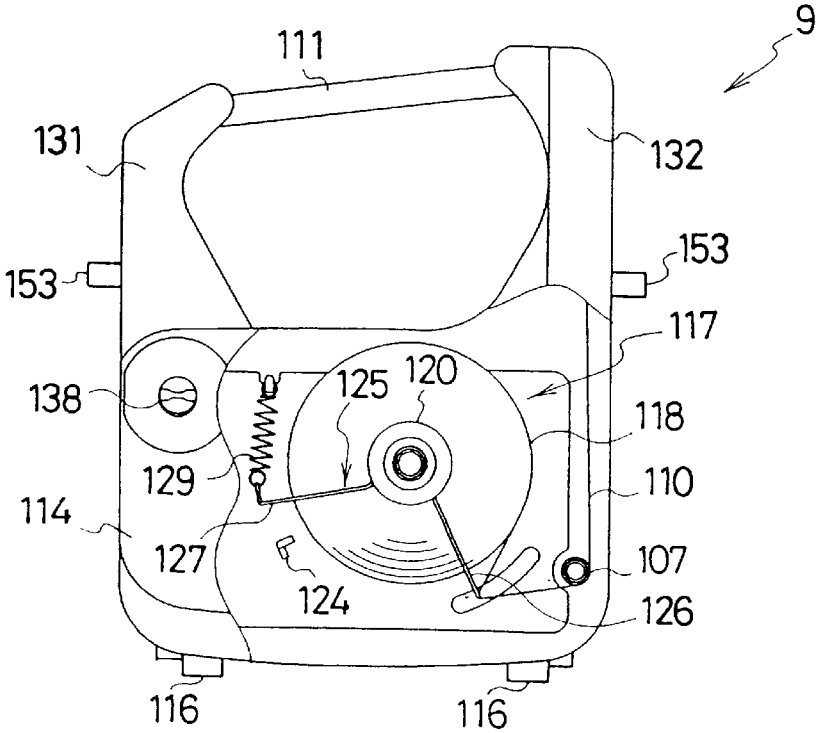
FIG. 13 is a partially cutaway, plan view of the ribbon cassette.

As shown in FIGS. 12 and 13, the ink ribbon 110 is forced by the tension spring 125 in the direction in which the tensile force increases. The tension spring 125 is forced in the clockwise direction in the drawing (i.e., in the direction in which the tensile force increases) by means of the extension spring 129. A regulating member 124 is formed on the cassette main body 112 in order to regulate the maximum degree of extension of the extension spring 129 by locking the joint lever 127. At the time of a normal printing operation, the regulating member 124 locks the joint lever 127, whereby an appropriate tensile force is afforded to the ink ribbon by means of the resilient force of the tension spring 125. If the tensile force increases for any reasons, the curved section 128 resiliently deforms so as to increase the angle between the engaging lever 126 and the joint lever 127. The diameter of the curved section 128 increases, and hence the feed spool 117 relatively rotates with respect to the curved section 128, so that the ink ribbon 110 is unreeled. In this way, the tensile force of the ink ribbon 110 is appropriately controlled.

When the linear portion 111 of the ink ribbon 110 is switched to the nonprintable position in which the linear portion is held horizontally, the ink ribbon 110 becomes loose, and hence its tensile force eventually decreases. At this time, the curved section 128 resiliently deforms so as to reduce its diameter, and hence the feed spool 117 is fixed with respect to the curved section 128. As shown in FIG. 13, the tension spring 125 and the feed spool 117 are forced in the direction in which the tensile force increases by means of the resilient tensile force of the extension spring 129. As a result, the tensile force of the ink ribbon 110 is appropriately controlled. In this way, the tensile force of the ink ribbon 110 is automatically controlled in an appropriate manner by means of the tension spring 125 and the extension spring 129. In consequence, even in the case where the degree of slack in the ink ribbon increases as a result of the switching of the position of the ink ribbon 110, the slack is reliably taken up, and the tensile force of the ink ribbon 110 can be maintained at an appropriate level.

As shown in FIGS. 10, 11, and 14 to 19, a ribbon guide section 140, for guiding the left end of the linear portion 111 of the ink ribbon 110 in parallel with the platen surface 17 is formed close to the rear end of the left ribbon support section 131 so as to be integrated with the cassette main body 112. A second ribbon guide section 142 is formed close to the rear end of the right ribbon support section 132. The ribbon guide 141 is attached to the second ribbon guide section 142 so as to be movable in the vertical direction in parallel with the platen surface 17, and the second ribbon guide section 142 guides the right end of the linear portion 111 in parallel with the platen surface 17. In short, the linear portion 111 of the ink ribbon 110 is positioned in parallel with the platen surface 17, and is switched between the printable position and the nonprintable position while it is held in the parallel condition.

A pair of pins 143 project from the both side surfaces of the ribbon guide 141. The pins 143 are movably fitted into inclined pin guide holes 144 (a guide support regulating section) formed in the ribbon support section 132. As a result, the direction of the movement of the ribbon guide 141 is regulated. An actuating section 145 is integrally formed on the top of the ribbon guide 141 so as to project out of the cassette main body 112 so that it can be actuated by fingers. As a result of the ribbon guide 141 being vertically moved using the ribbon slider 65, the linear portion 111 of the ink ribbon 110 is switched between the nonprintable position and the printable position.

Figure 14:
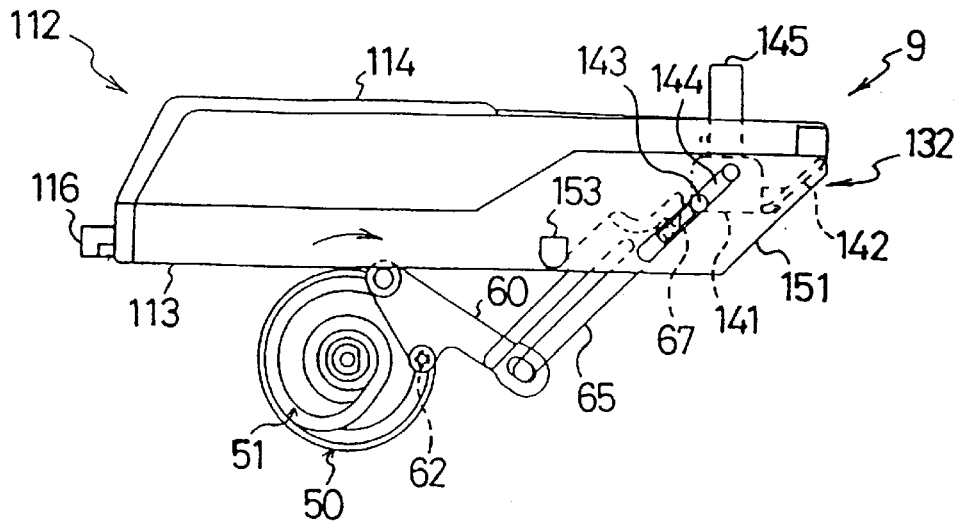
FIG. 14 is a side view of the ribbon cassette, a cam body, and a ribbon slider.
Figure 16:
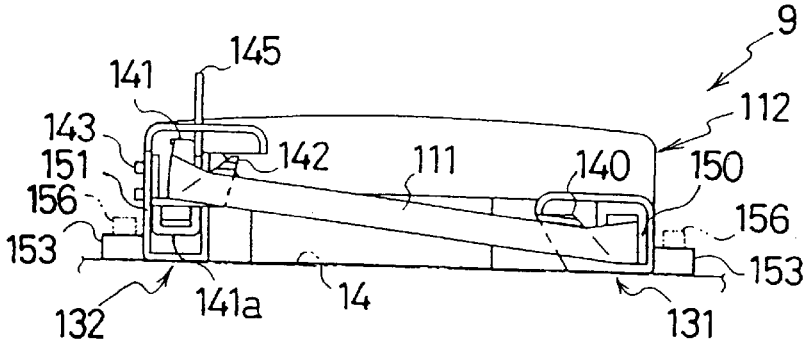
FIG. 16 is a rear view of the ribbon cassette when the ink ribbon is set in the printable position.
Figure 18:
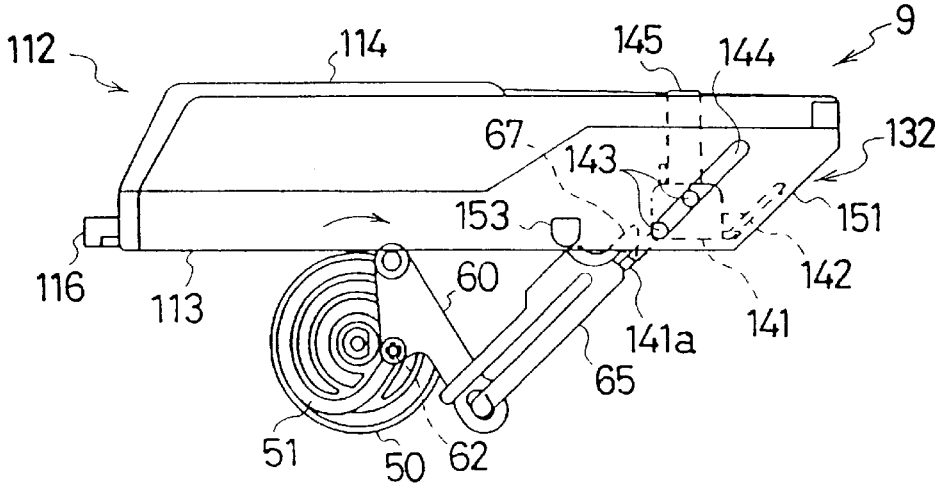
FIG. 18 is a side view of the ribbon cassette, the cam member, and the ribbon slider.
Figure 19:
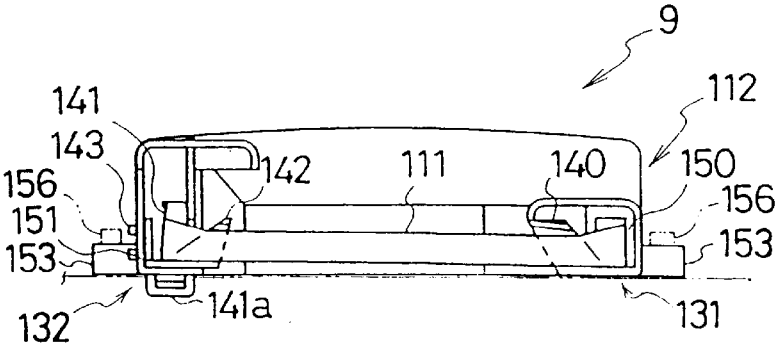
FIG. 19 is a rear view of the ribbon cassette when the ink ribbon is set in the nonprintable position.

As designated by the chain line in FIG. 15, which is a view from the operator's position, the end, of the linear portion 111 of the ink ribbon 110 in the direction in which the printing operation is carried out, is raised to a higher level when the linear portion is situated at the printable position. As a result, it is easy for the operator to see the sequence of printed letters. The print hammer 41 is struck in the direction designated by the arrow "p." As designated by the solid line in FIG. 15, the linear portion 111 of the ink ribbon 110 is horizontally situated below the sequence of letters which are currently printed (e.g., A–D) when the linear portion is situated in the nonprintable position. FIGS. 11, 14, and 16 show the ink ribbon 110 situated in the printable position, and FIGS. 17 to 19 show the ink ribbon 110 situated in the nonprintable position.

Figure 17:
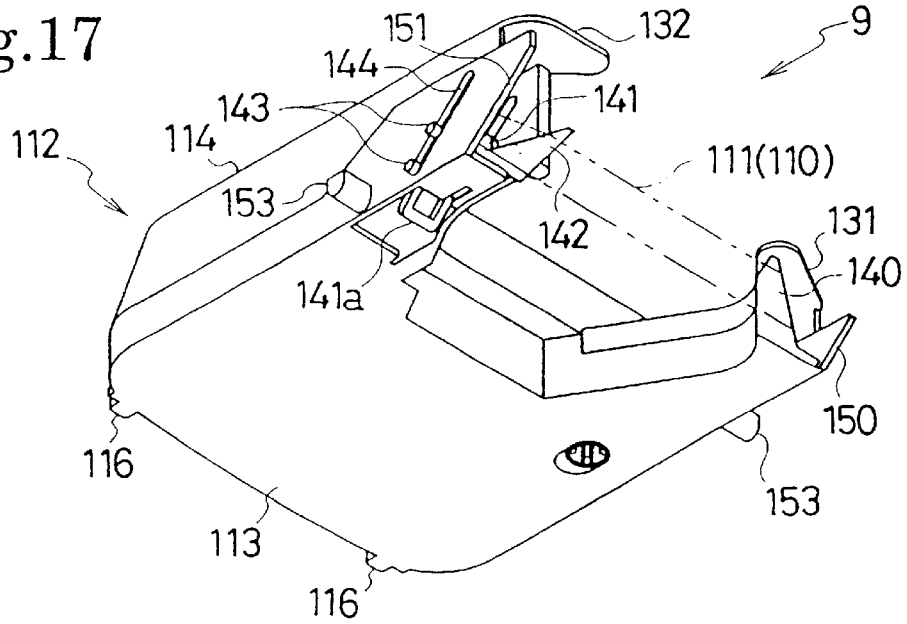
FIG. 17 is a perspective view of the ribbon cassette.
Figure 20:
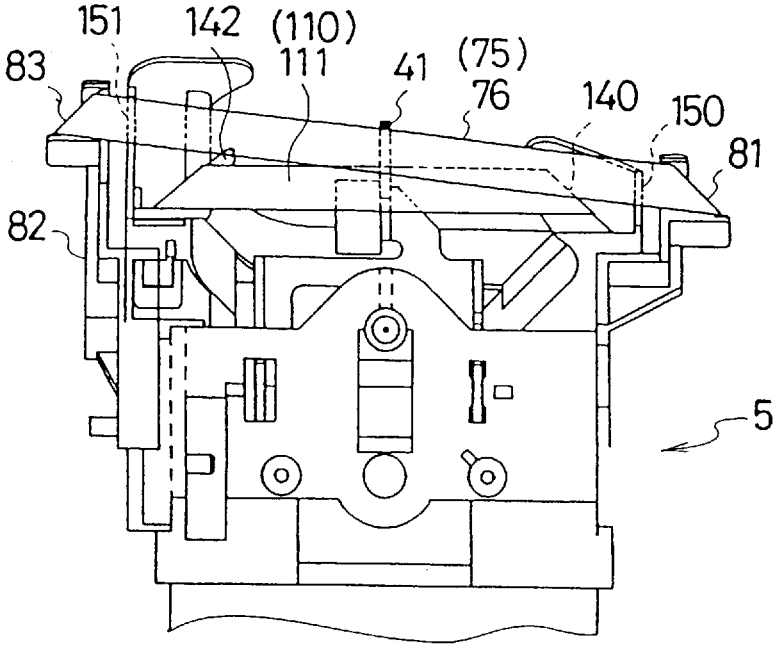
FIG. 20 is rear view of a carriage.
Figure 21:
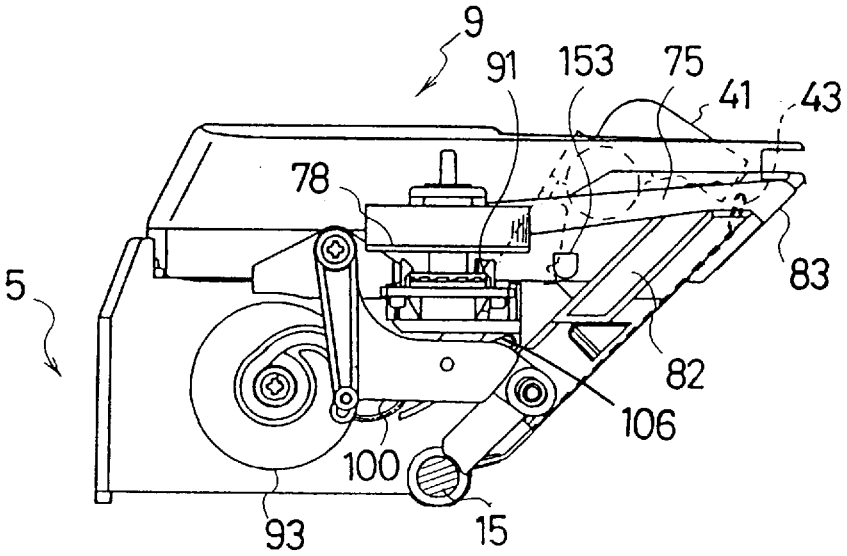
FIG. 21 is a right side view of the carriage.
Figure 22:
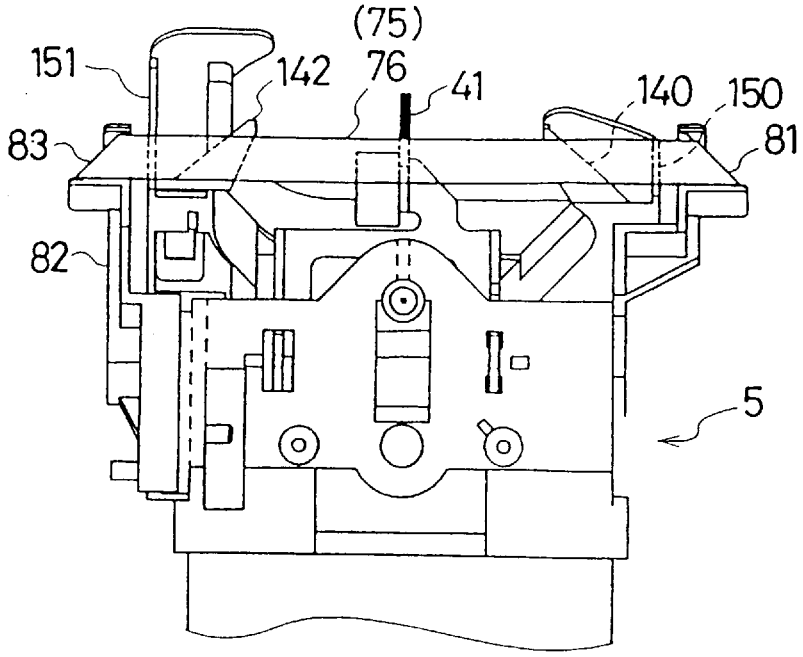
FIG. 22 is a rear view of the carriage.
Figure 23:
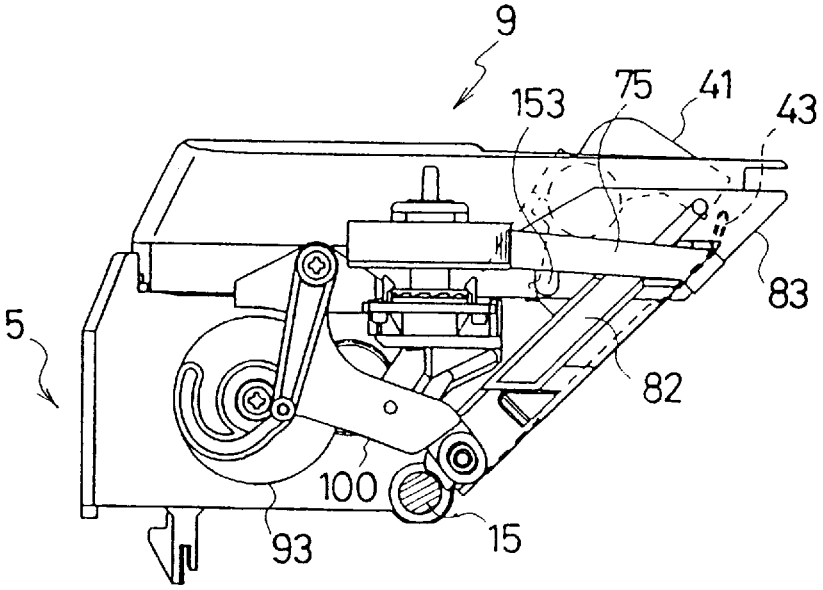
FIG. 23 is a right side view of the carriage.
Figure 24:
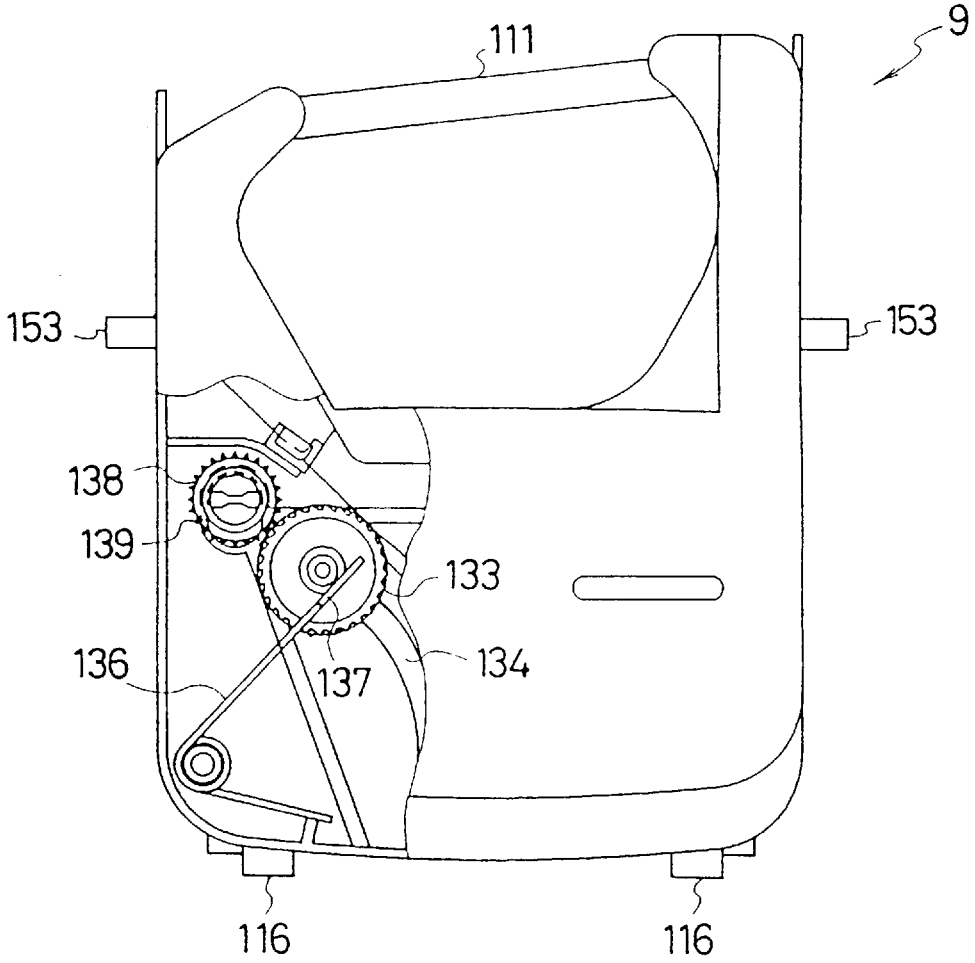
FIG. 24 is a partially cutaway, plan view of the ribbon cassette.

As shown in FIGS. 11 and 17, in order to guide and arrange the linear portion 76 of the correction tape 75 so as to be positioned directly behind, in parallel to, the linear portion 111 of the ink ribbon 110, a pair of tape guides 150, 151 are formed outside the pair of ribbon guide sections 140, 142 so as to be positioned slightly behind the same. FIGS. 20 and 21 show the linear portion 76 of the correction tape 75 switched to the correctable position, and FIGS. 22 and 24 show the linear portion 76 of the correction tape 75 switched to the uncorrectable position.

The correction tape 75, drawn from the feed spool 78, arrives at the tape guide 150 of the left ribbon support section 131 via the left guide section 81 formed on the carriage 5. The left edge of the linear portion 76 of the correction tape 75 is guided by the tape guide 150, and the linear portion is extended toward the right side of the carriage. Then, the right edge of the linear portion 76 is guided by the right tape guide 151, and it arrives at the guide section 83 of the tape slider 82. Eventually, the correction tape is taken up by the take-up spool 85.

As shown in FIG. 20, when the printed letters are erased, the ink ribbon 110 is held in the nonprintable position, and the correction tape 75 is switched to the correctable position in which the side of the correction tape 75 in the direction of the print operation is carried out is raised. In this condition, the letters are erased. As shown in FIG. 22, if the printed letters are not erased, the correction tape 75 is retained horizontally in the uncorrectable position. In this way, the pair of tape guides 150, 151, for guiding the correction tape 75, are formed in the ribbon cassette 9, which renders the mechanism for guiding the correction tape 75 simple. In consequence, the number of parts is reduced, and the size of the printer becomes compact.

As described in the embodiment, the printer is provided with a platen having a sloping plane platen surface, and a print head is disposed so as to be opposite to the platen surface. In such a case, there is need to arrange the linear portion of the ink ribbon of the ribbon cassette at an angle. If the printer has such a structure as to permit vertical removing of the ribbon cassette, interference arises between the linear portion of the ink ribbon and the print head. For this reason, it is impossible to attach the ribbon cassette to or remove it from the cassette attachment surface of the carriage. To solve this problem, if another structure which makes it possible to remove or attach the ribbon cassette by moving it in the longitudinal and vertical directions, it becomes difficult to effect removable engagement between a drive roller for taking up the ribbon cassette and a drive shaft disposed close to the carriage for driving the drive roller.

This problem is solved in this embodiment. An explanation will now be given of the mechanism for removably attaching the ribbon cassette 9 to the cassette attachment surface 14 of the carriage 5 as well as for engaging the drive gear 73 disposed on the carriage 5 with the driver roller with pawls 138 disposed in the ribbon cassette 9. The typewriter 1 of this type is provided with the sloping plane platen surface 17, and the linear portion 111 of the ink ribbon 110 and the linear portion of the correction tape 75 are disposed in parallel to the platen surface 17. With this configuration, when the ribbon cassette 9 is attached to the carriage, it is necessary to place the linear portions 111, 76 behind the type wheel 40 and, then, to move them forwardly.

Figure 25:
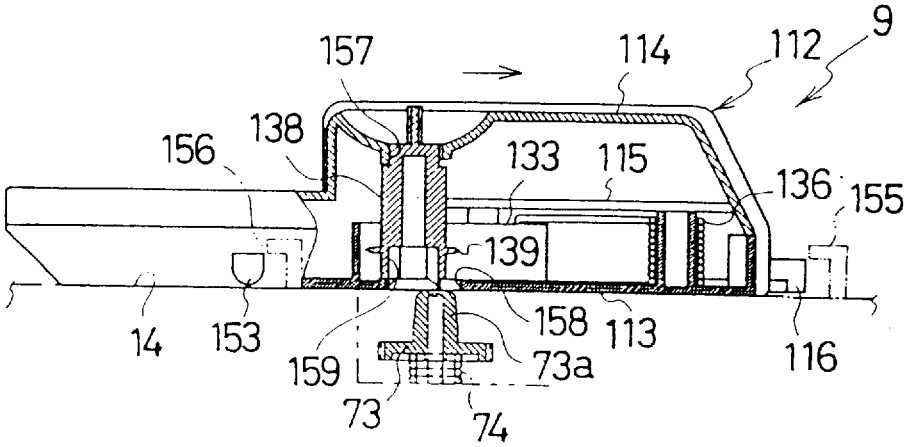
FIG. 25 is a partially cutaway, longitudinal side cross sectional view of the ribbon cassette when it is mounted on the carriage.
Figure 26:
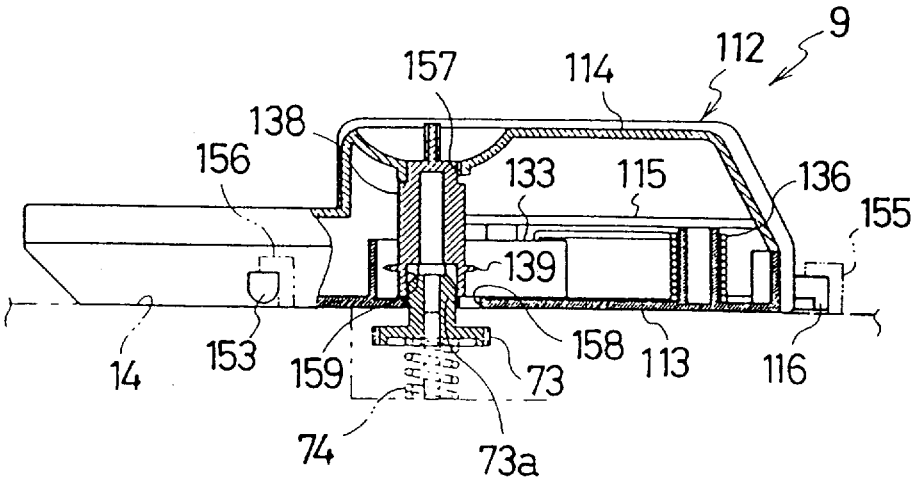
FIG. 26 is a partially cutaway, longitudinal side cross sectional view of the ribbon cassette when it is mounted on the carriage.
Figure 27:
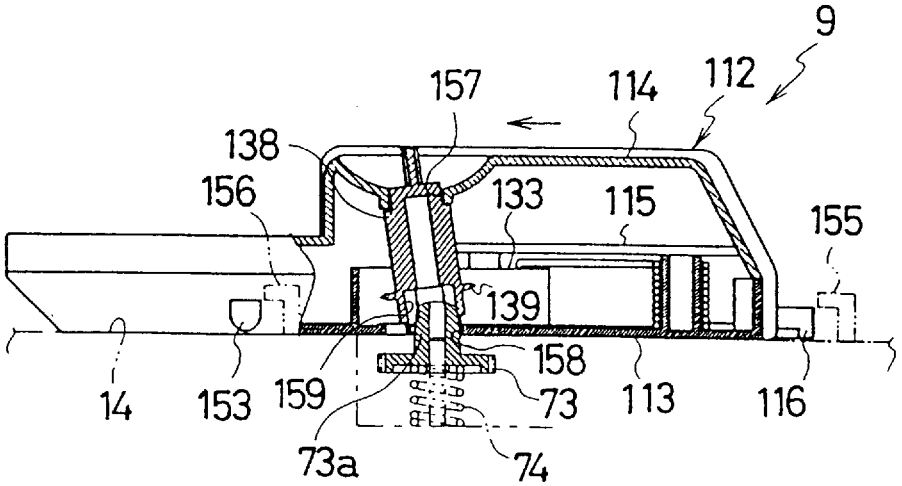
FIG. 27 is a partially cutaway, longitudinal side cross sectional view of the ribbon cassette when it is removed from the carriage.

As shown in FIGS. 24 to 26, the cassette attachment surface 14 of the carriage 5 is substantially planar. A pair of regulating elements 116 project forwardly from the lower front end of the cassette main body 112. Regulating elements 153 project from lower portions of both sides of the cassette main body 112. A pair of engaging sections 155 project from the cassette attachment surface 14 of the carriage 5 so that the pair of regulating elements 116 can engage them from behind. Further, a pair of engaging sections 156 project from the cassette attachment surface 14 so that the pair of engaging sections 155 can engage with them from behind. With this configuration, as a result of the engagement between the regulating elements 153, 116 and the engaging sections 155, 156, the ribbon cassette 110 is fixedly mounted on the cassette attachment surface 14.

In the ribbon cassette 9, the upper end of the drive roller with pawls 138 is supported in an annular hole 157 formed in the cassette main body 112, whereas the lower end of the drive roller with pawls 138 is movably supported in an elongated hole 158 which extends in the longitudinal direction of the cassette main body 112. An engaging hole 159 is formed in lower part of the drive roller with pawls 138, and the engaging hole 159 engages with the upper end of the drive gear 73 disposed on the carriage 5 so as to be able to transmit torque. The lower edge of the engaging hole 159 is tapered so as to have a larger diameter toward the outside or bottom for receiving and guiding the drive gear 73. As previously described, the drive gear 73 is supported so as to be able to vertically move, as well as being forced upward by the compression spring 74. An engaging shaft 73*a* is integrally formed in the upper part of the drive gear 73, and the engaging shaft 73*a* is tapered so as to have a smaller diameter toward its upper end.

When the ribbon cassette 9 is attached to the cassette attachment surface 14, the ribbon cassette 9 is placed on the cassette attachment surface 14, and it is moved forward, i.e., toward the operator, along the cassette attachment surface 14, as shown in FIG. 25. Then, the regulating elements 153, 116 are respectively engaged with the engaging sections 155, 156. At this time, the drive gear 73 is first held in a lowered position, as shown in FIG. 25. After the ribbon cassette 9 has been fixed at a predetermined position, the ribbon cassette is raised by means of the resilient force of the compression spring 74, as shown in FIG. 26 and the engaging shaft 73*a* engages with the engaging hole 159 of the drive roller with pawls 138. In this condition, the drive roller with pawls 138 is driven by the drive gear 73, which makes it possible to take up the ink ribbon 110.

When the ribbon cassette 9 is detached from the cassette attachment surface 14, the ribbon cassette 9 is moved rearwardly, i.e., away from the operator, along the cassette attachment surface 14. As a result, the lower end of the drive roller with pawls 138 moves along the inside of the elongated hole 158, which makes it possible to disengage the regulating elements 153, 116 from the engaging sections 155, 156. Subsequently, the ribbon cassette 9 can be removed upwardly. In this way, the drive gear 73 is moved vertically under the force of the compression spring 74. As a result, the drive roller with pawls 138 in the ribbon cassette 9 becomes relatively movable in relation to the cassette main body 112. With this configuration, the ribbon cassette 9 is easily removable, and the drive gear 73 is disengageable from the drive roller with pawls 138.

A modified example of the previously described ribbon cassette 9 will now be described.

Figure 28:
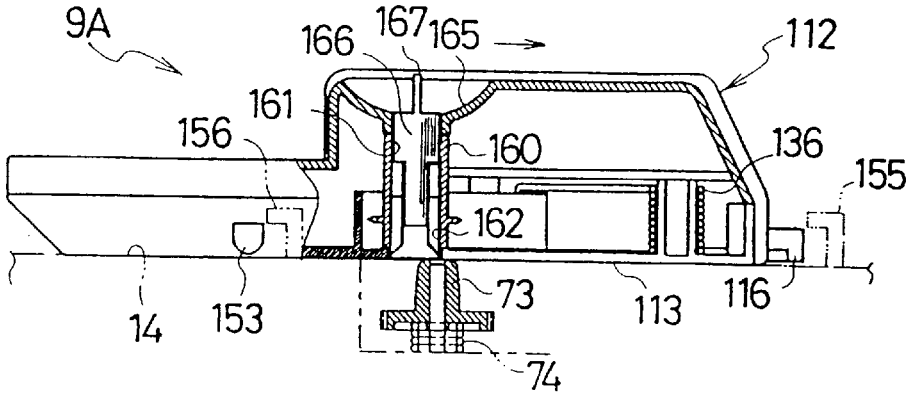
FIG. 28 is a partially cutaway, longitudinal side cross sectional view of a modified example of the ribbon cassette similar to FIG. 25.
Figure 29:
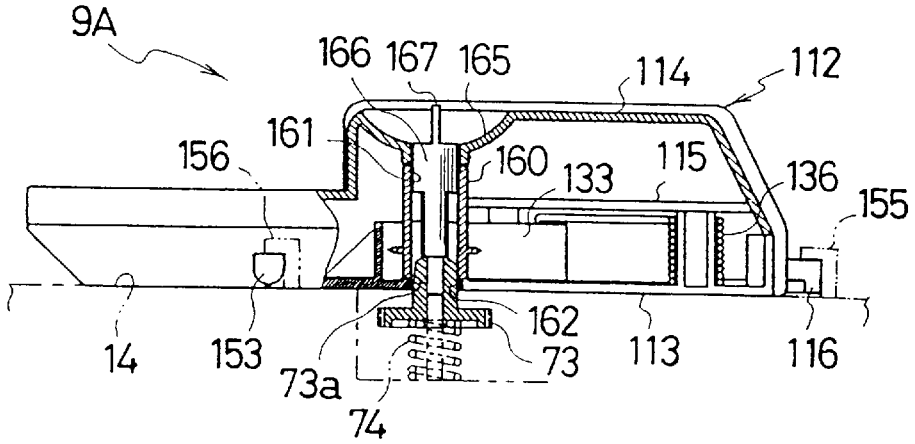
FIG. 29 is a partially cutaway, longitudinal side cross sectional view of the ribbon cassette shown in FIG. 28 which is similar to FIG. 26.
Figure 30:
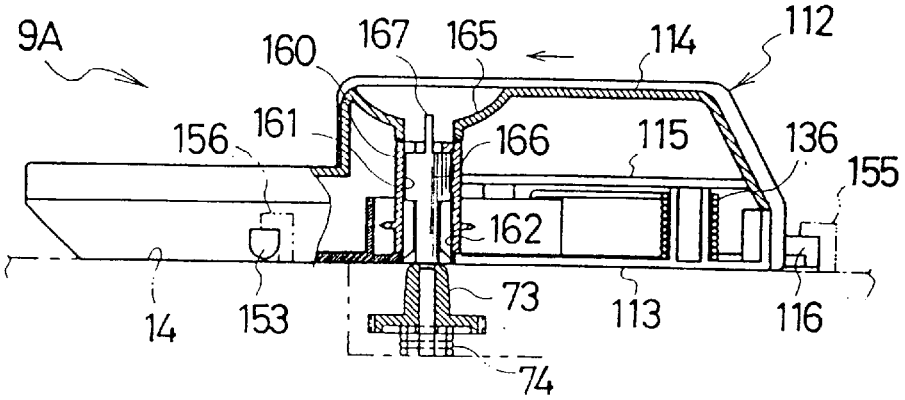
FIG. 30 is a partially cutaway, longitudinal side cross sectional view of the ribbon cassette shown in FIG. 28 which is similar to FIG. 27.

As shown in FIGS. 28 to 30, an indentation 165 is formed in the upper case 114 of the cassette main body 112 so as to be opposite to the upper end of a drive roller with pawls 160. A movable member 166 is axially, movably fitted in a center hole 161 of the drive roller with pawls 160. An actuating section 167 of the movable member 166 projects from the indentation 165. As a result of downwardly pressing the actuating section 167 with a finger, the drive roller with pawls 160 can be disengaged from the drive gear 73. The other features of a ribbon cassette 9A are the same as those of the ribbon cassette 9. The same reference numerals are provided to designate the corresponding features, and their explanations will be omitted here.

When the ribbon cassette 9A is attached to cassette attachment surface 14, the ribbon cassette is attached in the same manner as described in the previous embodiment, as shown in FIG. 28. At this time, the drive gear 73 is retained in a lowered position as a result of being pressed by the cassette main body 112. When the ribbon cassette 9A is fixed to the predetermined position, the drive gear 73 is raised by means of the resilient force of the compression spring 74, and the engaging shaft 73*a* engages with an engaging hole 162 of the drive roller with pawls 160. FIG. 29 shows the ribbon cassette 9A after it has been attached to the carriage. The drive roller with pawls 160 is rotated by the drive gear 73, so that the ink ribbon 110 is taken up.

When the ribbon cassette 9A is removed from the cassette attachment surface 14, the actuating section 167 of the movable section 166 is pressed by a finger, as shown in FIG. 30. As a result, the movable member 166 presses the drive gear 73 downward, and the drive roller with pawls 160 is disengaged from the drive gear 73. In this condition, the ribbon cassette 9A is rearwardly moved over a predetermined distance along the cassette attachment surface 14. The regulating elements 153, 116 are disengaged from the engaging sections 155, 156, which makes it possible to upwardly remove the ribbon cassette 9A. In this way, the indentation 165 is formed in the cassette main body 112, and the movable member 166 is fitted to the driver roller with pawls 160. By virtue of such a simple configuration, it is possible to disengage the drive gear 73 from the drive roller with pawls 160.

Figure 31:
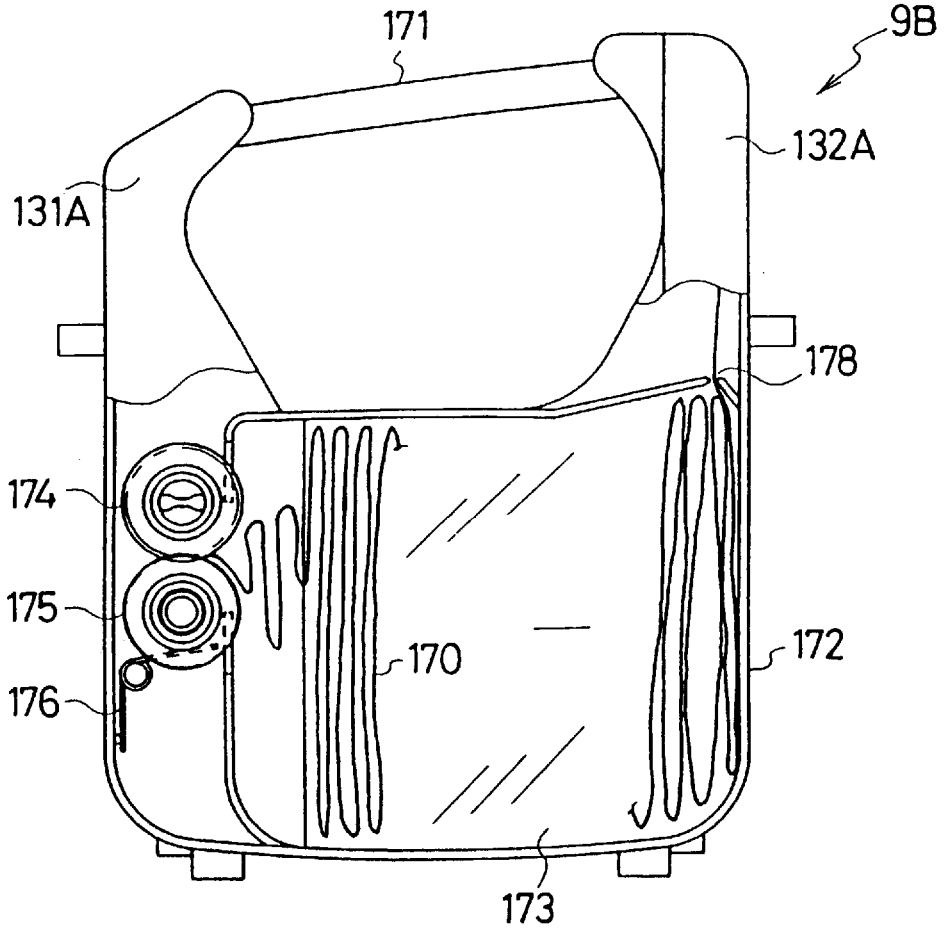
FIG. 31 is a partially cutaway, plan view of another modified example of the ribbon cassette.
Figure 32:
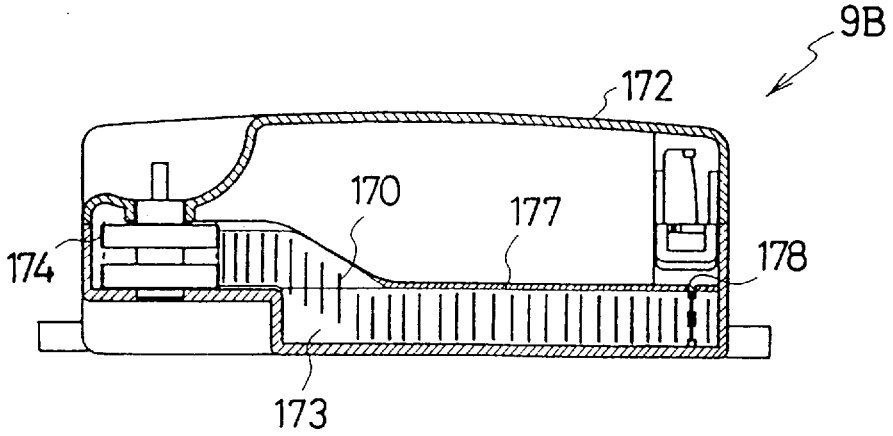
FIG. 32 is a longitudinally cross-sectional, front view of the ribbon cassette shown in FIG. 31.

Another type of ink ribbon is shown in FIGS. 31 and 32, a ribbon cassette 9B has an ink-soaked fabric ink ribbon 170. This ribbon cassette is intended to be used in the previously described typewriter 1.

A cassette main body 172 of the ribbon cassette 9B comprises a housing 173 for housing the fabric ink ribbon 170 in a folded manner, a drive-side take-up member 174 for taking up the ink ribbon 170, a driven-side take-up member 175 which is in contact with the drive-side take-up member 174, and a torsion spring 176 for forcing the driven-side take-up member 175 against the drive-side take-up member 174.

The bottom of the housing 173 is made lower than the bottoms of the take-up members 174, 175 by at least the width of the ink ribbon 170. A partition 177 is provided on the upper surface of the housing 173. A linear portion 171 of the ink ribbon 170, which is drawn from outlet port 178 formed in the right rear end of the housing 173 toward a ribbon support section 132A, is extended between ribbon support sections 131A, 132A in the same manner as previously described in the embodiment. The linear portion is guided into the left ribbon support section 131A, and it is then taken up by the two take-up members 174, 175. The thus taken up ribbon is then pushed into the housing 173. At this time, the bottom of the housing 173 is made lower than the bottoms of the take-up members 174, 175 by only the width of the ink ribbon 170. Hence, it is easy for the ink ribbon 170 to shift to the inside of the housing 173, which in turn reduces take-up load. As a result, take-up failures are prevented.

Further, the linear portion 111 of the ink ribbon 110 may be switched between the printable position and the nonprintable position by switching the position of the ribbon cassette 9 so as to be in parallel with the platen surface 17. In this case, the ribbon slider 65 is omitted, and the ribbon guide sections 140, 142 and the ribbon support sections 131, 132 are integrally formed.

Further, even when the ribbon cassette 9 is removably mounted on the ribbon attachment surface 14, the ribbon slider 65 is omitted, and the ribbon guide sections 140, 142 and the ribbon support sections 131, 132 are integrally formed. The ribbon guide section 142 may be elongated in the widthwise direction of the ink ribbon 110, and the ink ribbon 110 may be vertically moved in the vicinity of the ribbon guide section 142 so as to switch the position of the linear portion.

Although the invention has been described with reference to the illustrative embodiment in which the ribbon cassette of the invention is applied to an electronic typewriter, it goes without saying that the invention is applicable to a printer or a recorder, other than an electronic typewriter, in the same manner as previously described.

What is claimed is:

1. A recording apparatus, comprising:

a stationary platen having a sloping plane platen surface in relation to a horizontal plane that supports a recording medium;

a transparent paper guide that is pivotally mounted in a closed position to guide an upper side of the recording medium and in an open position to open the paper guide and expose the platen;

two pairs of drive and driven rollers that carry the recording medium along a plane including the sloping plane platen surface, one pair of drive and driven rollers being disposed in an upstream position with respect to the platen as defined by a print movement direction of the recording medium and the other pair of drive and driven rollers being disposed in a downstream position, wherein the driven rollers are rotatably attached to the transparent paper guide.

2. The recording apparatus of claim 1 wherein the transparent paper guide comprises a pair of transparent paper guides, each pivotally mounted and individually positionable in the open and closed positions.

3. The recording apparatus of claim 2, wherein each transparent paper guide supports a driven roller.

4. The recording apparatus of claim 2, wherein each transparent paper guide is spring biased in the closed position.

5. The recording apparatus according to claim 1, wherein a tapered portion is formed at an end of the transparent paper guide.

6. The recording apparatus according to claim 1, wherein a spring member forces the transparent paper guide to the closed position.

7. The recording apparatus according to claim 6, wherein the spring member is positioned so as not to impair visibility of the recording medium.

8. The recording apparatus according to claim 1, wherein the platen surface lies at a rear upward gradient of approximately 20 to 70 degrees in relation to a horizontal plane of the recording apparatus.

9. The recording apparatus according to claim 1, wherein the platen surface lies at a rear upward gradient of approximately 40 to 45 degrees in relation to a horizontal plane of the recording apparatus.

10. A recording apparatus, comprising:

a stationary platen having a sloping plane platen surface;

a medium guide path for guiding a recording medium such that the recording medium is carried along a plane including a base plate and a transparent paper guide mounted above the base plate in a closed position, so as to be opposite to the base plate in such a way as to guide the recording medium while ensuring a clearance for passage of the medium, and in an open position in which the transparent paper guide is opened upwardly away from the platen; and a medium feed member for carrying the recording medium along the medium guide path, the medium feed member including at least one pair of drive and driven rollers disposed in at least one of an upstream position and a downstream position with respect to a direction in which the recording medium is fed in relation to the platen, wherein the at least one driven roller is rotatable attached to the transparent paper guide.

11. The recording apparatus according to claim 10, wherein the medium feed member includes two pairs of drive and driven rollers, with one pair of drive and driven rollers being disposed in an upstream position with respect to a direction, in which the recording medium is fed, in relation to the platen and the other pair of drive and driven rollers being disposed in a downstream position.

12. The recording apparatus according to claim 10, wherein a spring member forces the transparent paper guide to the closed position and is positioned so as not to impair visibility of the recording medium.

13. The recording apparatus according to claim 10, wherein the platen surface lies at a rear upward gradient of approximately 20 to 70 degrees with a rear upward gradient in relation to a horizontal plane of the recording apparatus.

14. The recording apparatus of claim 10, wherein a diameter of the at least one driven roller is smaller than the diameter of the at least one drive roller.

15. The recording apparatus of claim 10, wherein the transparent paper guide comprises a pair of linearly arranged paper guides, each pivotally biased in the closed position.

* * * * *